US011576468B2

(12) United States Patent
Panian

(10) Patent No.: US 11,576,468 B2
(45) Date of Patent: Feb. 14, 2023

(54) VACUUM ADJUSTMENT DEVICE FOR ARTICLE OF APPAREL OR FOOTWEAR

(71) Applicant: NIKE, Inc., Beaverton, OR (US)

(72) Inventor: Nadia M. Panian, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 108 days.

(21) Appl. No.: 17/073,315

(22) Filed: Oct. 17, 2020

(65) Prior Publication Data

US 2021/0120915 A1 Apr. 29, 2021

Related U.S. Application Data

(60) Provisional application No. 62/925,345, filed on Oct. 24, 2019.

(51) Int. Cl.

| | |
|---|---|
| ***A43B 23/26*** | (2006.01) |
| ***A43B 23/02*** | (2006.01) |
| ***A43B 3/26*** | (2006.01) |
| ***A43B 1/00*** | (2006.01) |
| *A41D 27/00* | (2006.01) |

(52) U.S. Cl.

CPC ..... *A43B 23/029* (2013.01); *A43B 1/0018* (2013.01); *A43B 3/26* (2013.01); *A43B 23/26* (2013.01); *A41D 27/00* (2013.01)

(58) Field of Classification Search

CPC ..... A43B 23/029; A43B 23/26; A43B 1/0018; A41D 27/00

See application file for complete search history.

(56) References Cited

U.S. PATENT DOCUMENTS

| | | | | |
|---|---|---|---|---|
| 1,493,605 A * | 5/1924 | Comstock | A43D 3/04 12/114.6 |
| 5,392,534 A * | 2/1995 | Grim | A43B 7/147 36/154 |
| 5,626,657 A * | 5/1997 | Pearce | A43B 5/0405 523/105 |
| 5,769,231 A * | 6/1998 | Batsford | B65D 81/052 206/522 |

(Continued)

FOREIGN PATENT DOCUMENTS

| | | |
|---|---|---|
| TW | I629428 B | 7/2018 |
| WO | WO-2018137440 A1 | 8/2018 |

OTHER PUBLICATIONS

European Patent Office (ISA), International Search Report and Written Opinion for PCT Application No. PCT/US2020/056462, dated Feb. 8, 2021.

(Continued)

*Primary Examiner* — Ted Kavanaugh
(74) *Attorney, Agent, or Firm* — Honigman LLP; Matthew H. Szalach; Jonathan P. O'Brien

(57) ABSTRACT

An article includes a receptacle defining an interior void and an adjustment element attached to the receptacle. The adjustment element includes bladder defining one or more chambers each having a compressible component disposed therein. The adjustment element is operable between a contracted configuration providing the receptacle with a first size and an expanded configuration providing the receptacle with a second size different than the first size by adjusting a pressure within the one or more chambers.

10 Claims, 24 Drawing Sheets

(56) References Cited

U.S. PATENT DOCUMENTS

| | | | | |
|---|---|---|---|---|
| 6,195,914 | B1 * | 3/2001 | Otis | A43B 3/26 36/11.5 |
| 6,782,640 | B2 * | 8/2004 | Westin | A43B 13/187 36/153 |
| 11,104,500 | B2 * | 8/2021 | Wetsch | A43D 3/04 |
| 2003/0046831 | A1 * | 3/2003 | Westin | A43B 13/187 36/43 |
| 2004/0003515 | A1 | 1/2004 | Marvin et al. | |
| 2011/0131831 | A1 | 6/2011 | Peyton et al. | |
| 2017/0360155 | A1 * | 12/2017 | Leary | A43B 23/081 |
| 2019/0000186 | A1 * | 1/2019 | Mou | A43B 23/029 |
| 2019/0069642 | A1 * | 3/2019 | Hughes | B65D 81/052 |
| 2020/0268111 | A1 * | 8/2020 | Chang | A43D 3/1433 |

OTHER PUBLICATIONS

Taiwan Office Action, Application No. 109136892, dated Jun. 22, 2021.

* cited by examiner

VACUUM ADJUSTMENT DEVICE FOR ARTICLE OF APPAREL OR FOOTWEAR

CROSS REFERENCE TO RELATED APPLICATIONS

This application claims priority to U.S. Provisional Application 62/925,345 filed on Oct. 24, 2019. The disclosure of this prior application is considered part of the disclosure of this application and is hereby incorporated by reference in its entirety.

FIELD

The present disclosure relates generally to an adjustment device for an article of apparel or footwear.

BACKGROUND

This section provides background information related to the present disclosure which is not necessarily prior art.

Articles of apparel such as garments and headwear and articles of footwear such as shoes and boots, typically include a receptacle for receiving a body part of a wearer. For example, an article of footwear may include an upper and a sole structure that cooperate to form a receptacle for receiving a foot of a wearer. Likewise, garments and headwear may include one or more pieces of material formed into a receptacle for receiving a torso or head of a wearer.

Articles of apparel or footwear are typically adjustable and/or are formed from a relatively flexible material to allow the article of apparel or footwear to accommodate various sizes of wearers, or to provide different fits on a single wearer. While conventional articles of apparel and articles of footwear are adjustable, such articles do not typically allow a wearer to conform the shape of the article to a body part of the wearer. For example, while laces adequately secure an article of footwear to a wearer by constricting a portion of an upper around the wearer's foot, the laces do not cause the upper to conform to the user's foot. Accordingly, an optimum fit of the upper around the foot is difficult to achieve.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1A:
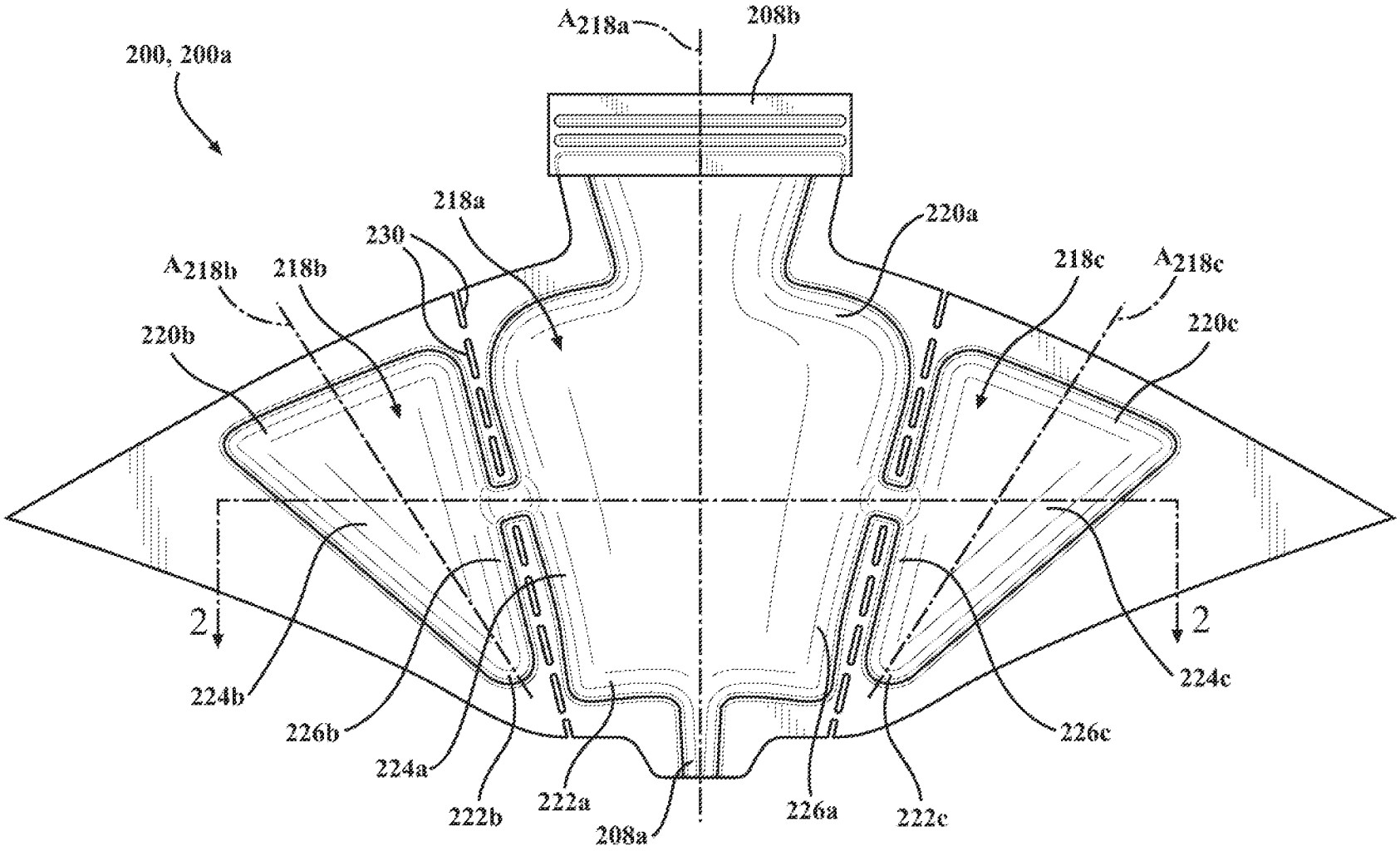
FIG. 1A is a top plan view of an adjustment element according the principals of the present disclosure, where the adjustment element is in an expanded state.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides an article. The article includes a receptacle defining an interior void and an adjustment element attached to the receptacle and including a bladder defining one or more chambers each having a compressible component disposed therein. The adjustment element is operable between a contracted configuration providing the receptacle with a first size and an expanded configuration providing the receptacle with a second size different than the first size by adjusting a pressure within the one or more chambers.

Implementations of the disclosure may include one or more of the following optional features.

In some examples, the receptacle includes an opening providing access to the interior void. The adjustment element is disposed adjacent to the opening and operable to move the opening between the first size and the second size.

In some implementations, the bladder includes a first barrier layer and a second barrier layer joined together at discrete locations to define the one or more chambers. Here, the bladder may include a first bearing layer adjacent to the first barrier layer and a second bearing layer adjacent to the second barrier layer. In some examples, the compressible component is disposed between the first bearing layer and the second bearing layer. Here, the first bearing layer and the second bearing layer have a lower coefficient of friction than the first barrier layer and the second barrier layer. In some examples, the bearing layer is formed of a fabric material.

In some implementations, the compressible component includes a unitary element.

In some configurations, the compressible component includes a plurality of compressible particles. Optionally, the plurality of compressible particles are spherical beads.

In some examples, the compressible component is formed of a foam material.

In some configurations, the adjustment element includes a valve providing fluid communication between each of the one or more chambers and an exterior of the bladder.

In some examples, the one or more chambers includes a plurality of the chambers. Here, the plurality of the chambers are in fluid communication with each other.

In some implementations, wherein the receptacle is an upper of an article of footwear. Here, the adjustment element may be disposed on an instep region of the upper. In some configurations, the adjustment element includes a first wing chamber attached to the upper on a lateral side, a second wing chamber attached to the upper on a medial side, and a central chamber disposed between and connecting the first wing chamber and the second wing chamber. In the contracted configuration the first wing chamber and the second wing chamber are folded between the central chamber and the upper, and in the expanded configuration the first wing chamber and the second wing chamber are spaced outwardly from the central chamber.

In some examples, the receptacle is a shirt.

Another aspect of the disclosure provides an adjustment element comprising a bladder forming an interior void having a plurality of chambers. The compressible component has a portion disposed within each one of the chambers. A first valve is attached to the bladder and provides fluid communication between the interior void and an exterior of the bladder.

Implementations of the disclosure may include one or more of the following optional features.

In some examples, the bladder includes a first barrier layer and a second barrier layer joined to the first barrier layer along a web area to define each of the plurality of the chambers. In some configurations, web area defines a central chamber, a first wing chamber on a first side of the central chamber, and a second wing chamber on a second side of the central chamber. In some examples, the web area defines a first series of elongate chambers and a second series of elongate chambers that diverge from the first series of the elongate chambers. In some implementations, the web area defines an auxetic structure.

In some examples, the bladder includes a first bearing layer covering the first barrier layer within each of the plurality of the chambers and a second bearing layer covering the second barrier layer within each of the plurality of the chambers.

In some implementations, the compressible component includes a plurality of unitary compressible elements each disposed within one of the chambers.

In some configurations, the compressible component is a plurality of compressible particles.

In some examples, the first valve is a bi-directional valve. In some configurations, the bladder includes the first valve and a second valve, the first valve being a one-way intake valve and the second valve being a one-way exhaust valve.

In some examples, the adjustment element includes a pump in communication with the interior void through the first valve.

In another aspect of the disclosure, the adjustment element may be incorporated into any one of an article of footwear or an article of clothing.

With reference to FIGS. 1-14B, different examples of an adjustment element for an article of apparel or an article of footwear are shown. Generally, the adjustment element is operable between an expanded configuration and a contracted configuration to adjust a size of the article. As discussed in greater detail below, the adjustment element includes a bladder having a compressible component disposed therein. The adjustment element can be moved between the expanded configuration and the contracted configuration by adjusting a pressure within the bladder to move the compressible component between a compressed state and a relaxed or decompressed state. Depending on an arrangement of seams of the bladder, movement of the bladder from the compressed state to the expanded state may move the adjustment element from a contracted configuration to an expanded configuration, or vice versa. Additionally, the seams of the bladder may be configured to effect two-way expansion and contraction or four-way, auxetic expansion and contraction. While the examples below are directed towards articles of footwear and shirts, the adjustment elements of the present disclosure may be incorporated into any article of apparel or article of footwear where an adjustable fit is desired.

Generally, each of the examples described below includes an article of apparel or footwear 10-10*g* having a receptacle 100, 100*a* defining an interior void 102, 102*a* for receiving a body part. For example, the receptacle 100, 100*a* may be an article of footwear 100 or a shirt 100*a*. The receptacle 100, 100*a* may include one or more openings 104, 104*a* providing access to the interior void 102, 102*a*. The receptacle 100, 100*a* may further include an adjustment region 106, 106*a* configured for adjusting a size of the receptacle 100, 100*a* and the interior void 102, 102*a*. In some examples, the adjustment region 106, 106*a* extends from the opening 104, 104*a* and is configured to adjust a size of the opening 104, 104*a*. However, the adjustment region 106, 106*a* may be also be spaced apart from the opening 104, 104*a* such that an intermediate portion of the receptacle 100, 100*a* can be expanded or contracted around the respective body part of the wearer. The article of apparel or footwear 10-10*g* may further include an adjustment element 200-200*d* attached to the receptacle 100, 100*a* and configured to move between the expanded state and the contracted state to adjust a size of the receptacle 100, 100*a*.

With particular reference to FIGS. 1A-3B, an adjustment element 200, 200*a* is provided and is configured to attach to an upper 110 of an article of footwear 100 (FIGS. 4A-4C) to adjust a size of an adjustment region 106 of the article of footwear 100 around the foot. The adjustment element 200, 200*a* includes a bladder 202 forming an interior void 204 having a compressible component 206, 206*a* disposed therein. The bladder 202 further includes at least one valve 208*a*, 208*b* providing fluid communication between the interior void 204 and an exterior of the bladder 202.

Figure 2A:
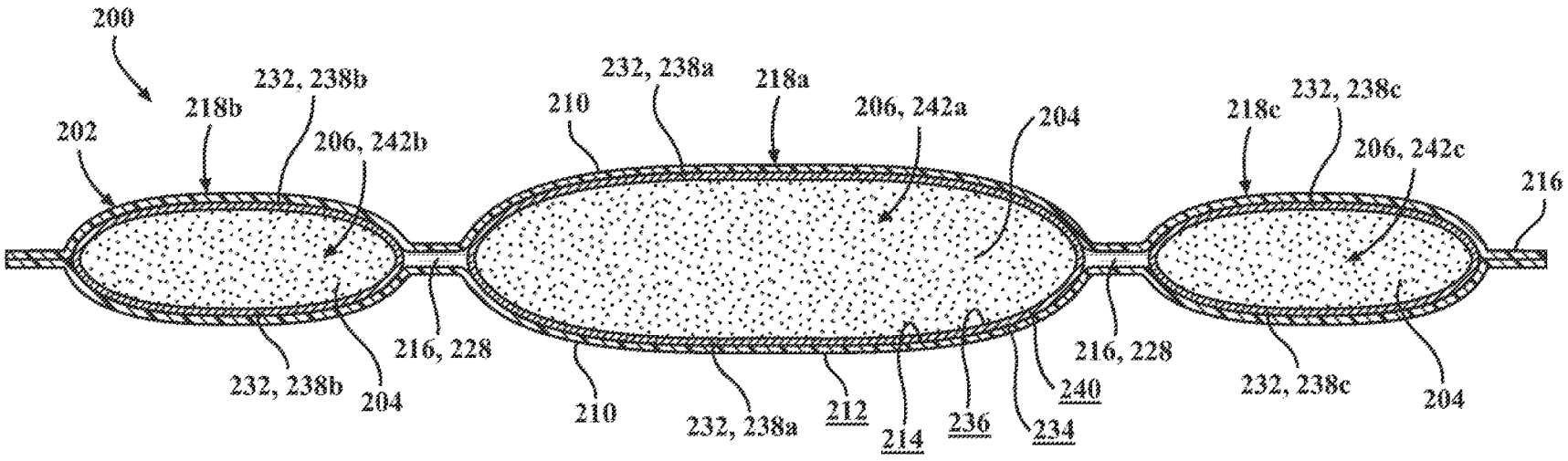
FIGS. 2A and 2B are cross-sectional views of the adjustment element of FIG. 1A, taken at section line 2-2 in FIG. 1A.
Figure 3A:
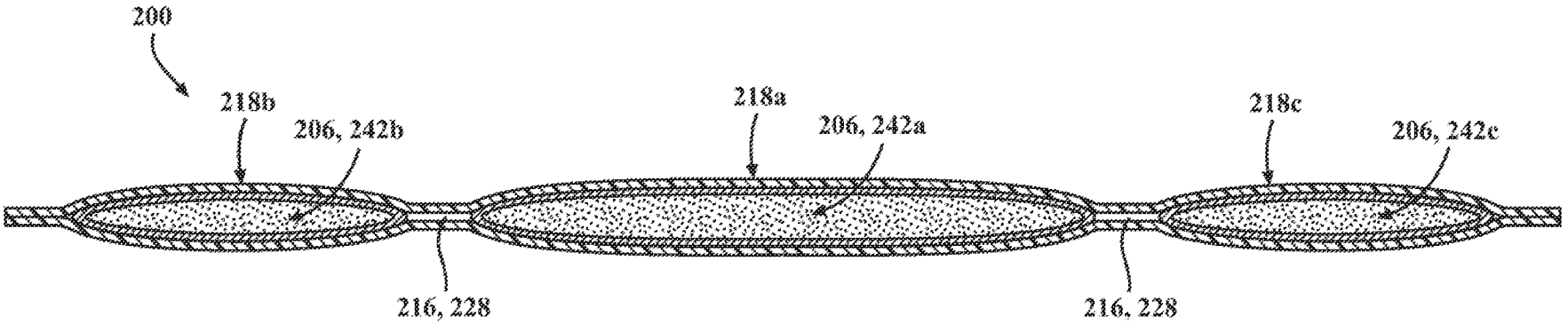
FIGS. 3A and 3B are cross-sectional views of the adjustment element of FIG. 1A, taken at section line 3-3 in FIG. 1B.
Figure 3B:
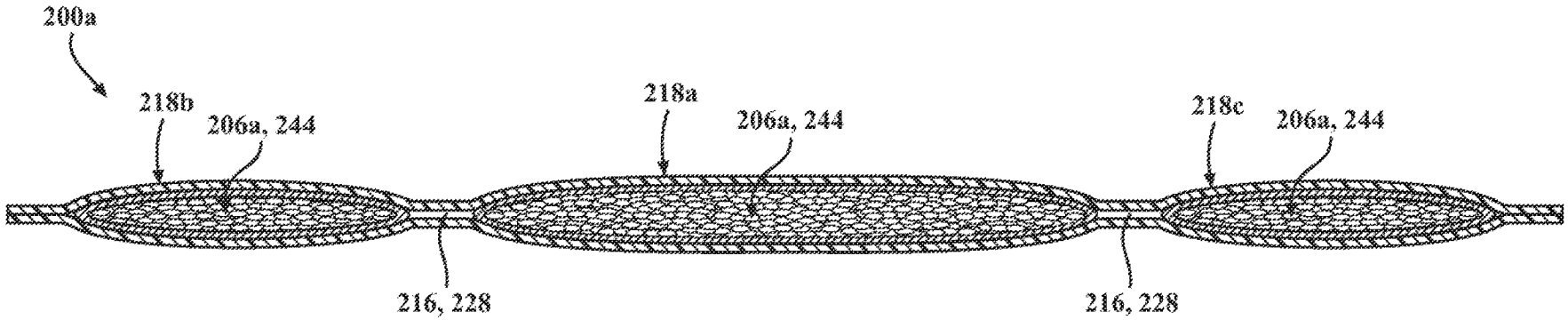

As best shown in FIGS. 2A and 3A, the bladder 202 includes a pair of barrier layers 210 each having an exterior surface 212 and an interior surface 214 formed on an opposite side of the barrier layer 210 from the exterior surface 212. The interior surfaces 214 of the barrier layers 210 oppose or face each other, and are joined to each other along a seam 216 to separate the bladder 202 into a plurality of chambers 218*a*-218*c*.

As used herein, the term "barrier layer" (e.g., barrier layers 210) encompasses both monolayer and multilayer films. In some embodiments, one or both of barrier layers 210 are each produced (e.g., thermoformed or blow molded) from a monolayer film (a single layer). In other embodiments, one or both of the barrier layers 210 are each produced (e.g., thermoformed or blow molded) from a multilayer film (multiple sublayers).

The barrier layers 210 can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4, 4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The bladder 202 can be produced from the barrier layers 210 using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like.

Figure 1B:
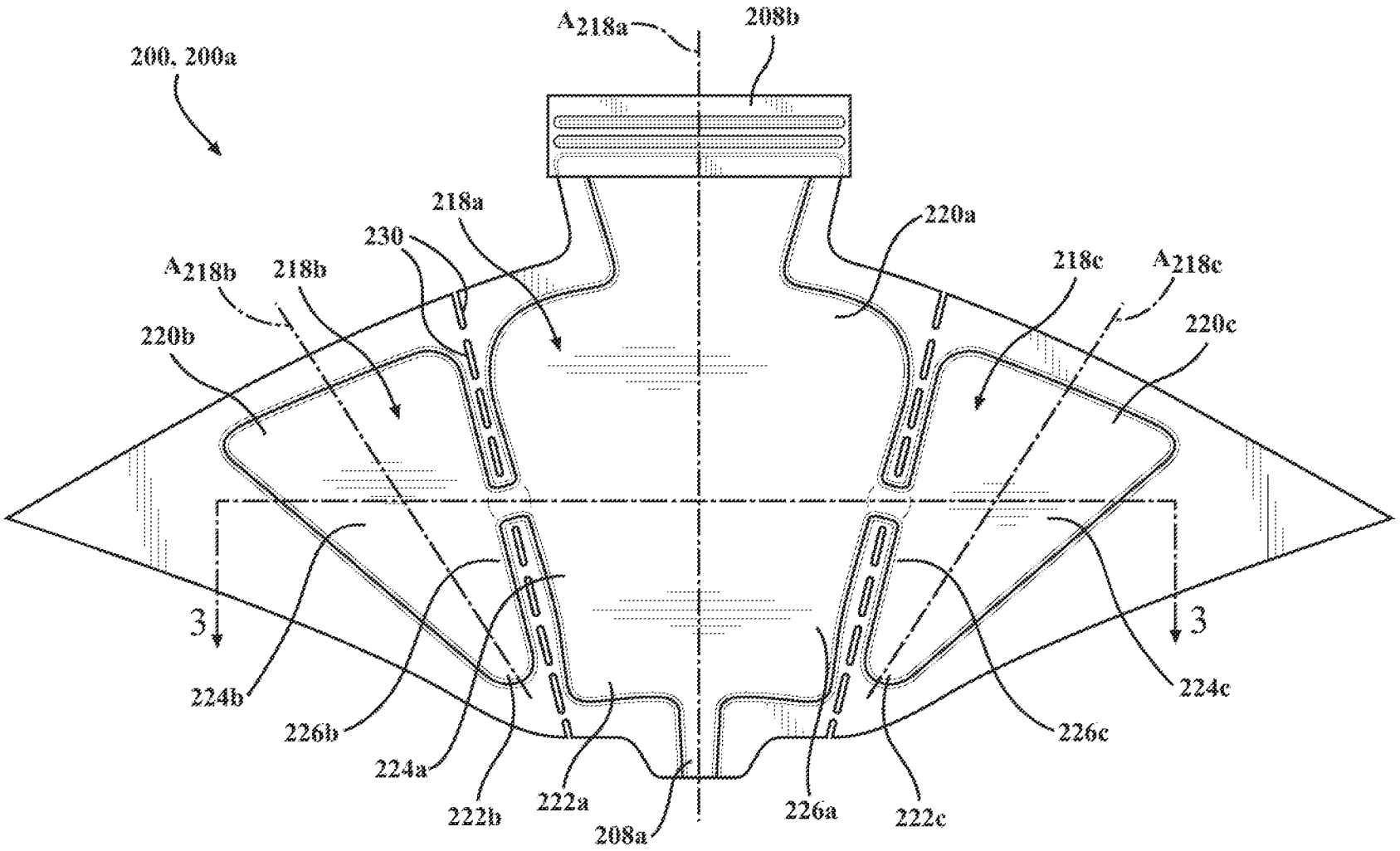
FIG. 1B is a top plan view of the adjustment element of FIG. 1, where the adjustment element is in a compressed state.

In the illustrated example, the bladder 202 includes a central chamber 218*a* and a pair of wing chambers 218*b*, 218*c* attached to opposite sides of the central chamber 218*a* from each other. With reference to FIGS. 1A and 1B, each of the chambers 218*a*-218*c* extends along a longitudinal axis $A_{218a}$-$A_{218c}$ from a first end 220*a*-220*c* to a second end 222*a*-222*c* disposed on an opposite end of the chamber 218*a*-218*c* from the first end 220*a*-220*c*. Each of the chambers 218*a*-218*c* further includes a pair of sides 224*a*-224*c*, 226*a*-226*c* extending from the respective first end 220*a*-220*c* to the respective second end 222*a*-222*c*.

Figure 4A:
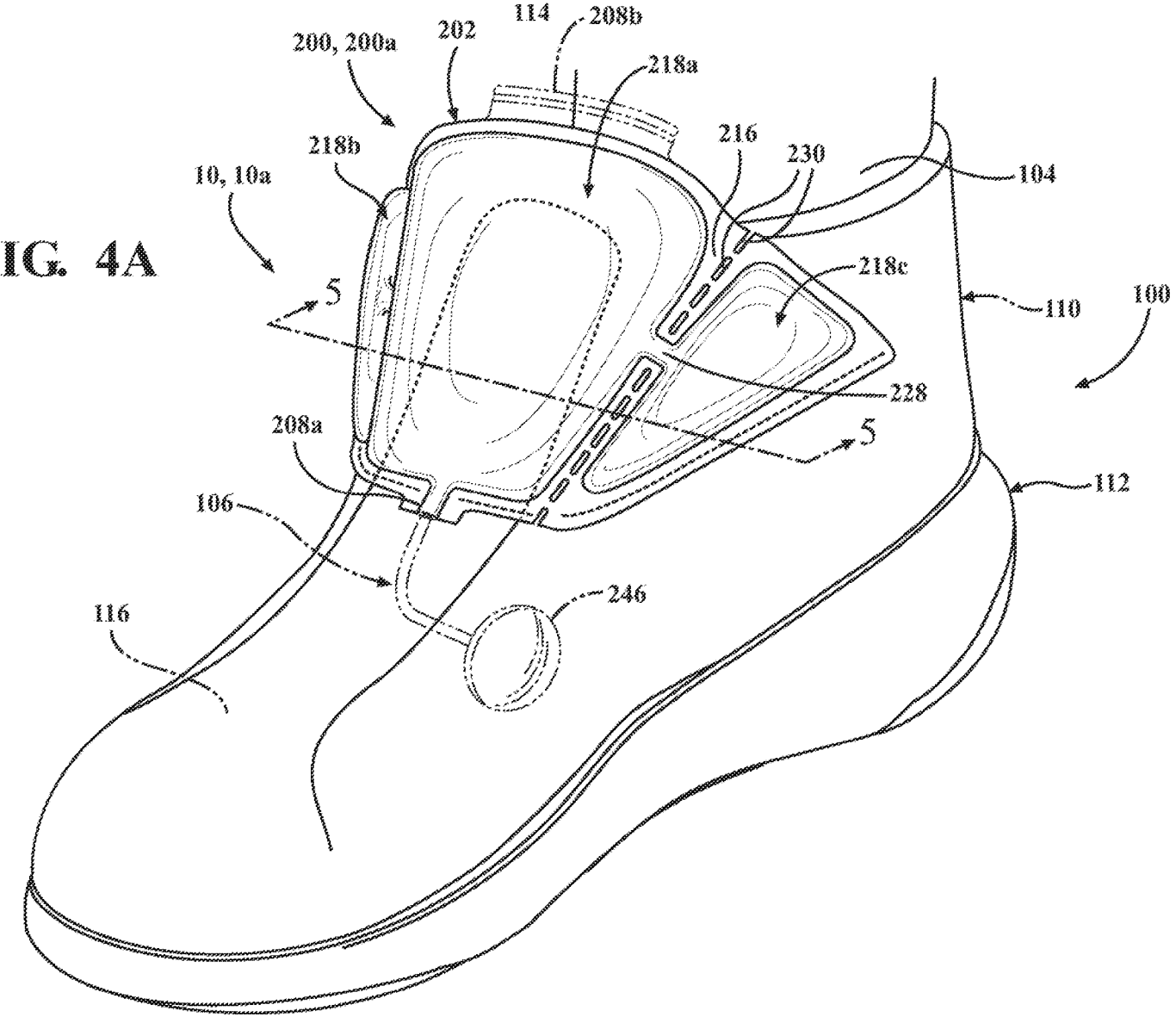
FIG. 4A is a perspective view of an article of footwear incorporating the adjustment element of FIG. 1A, where the adjustment element is in an expanded configuration.
Figure 4B:
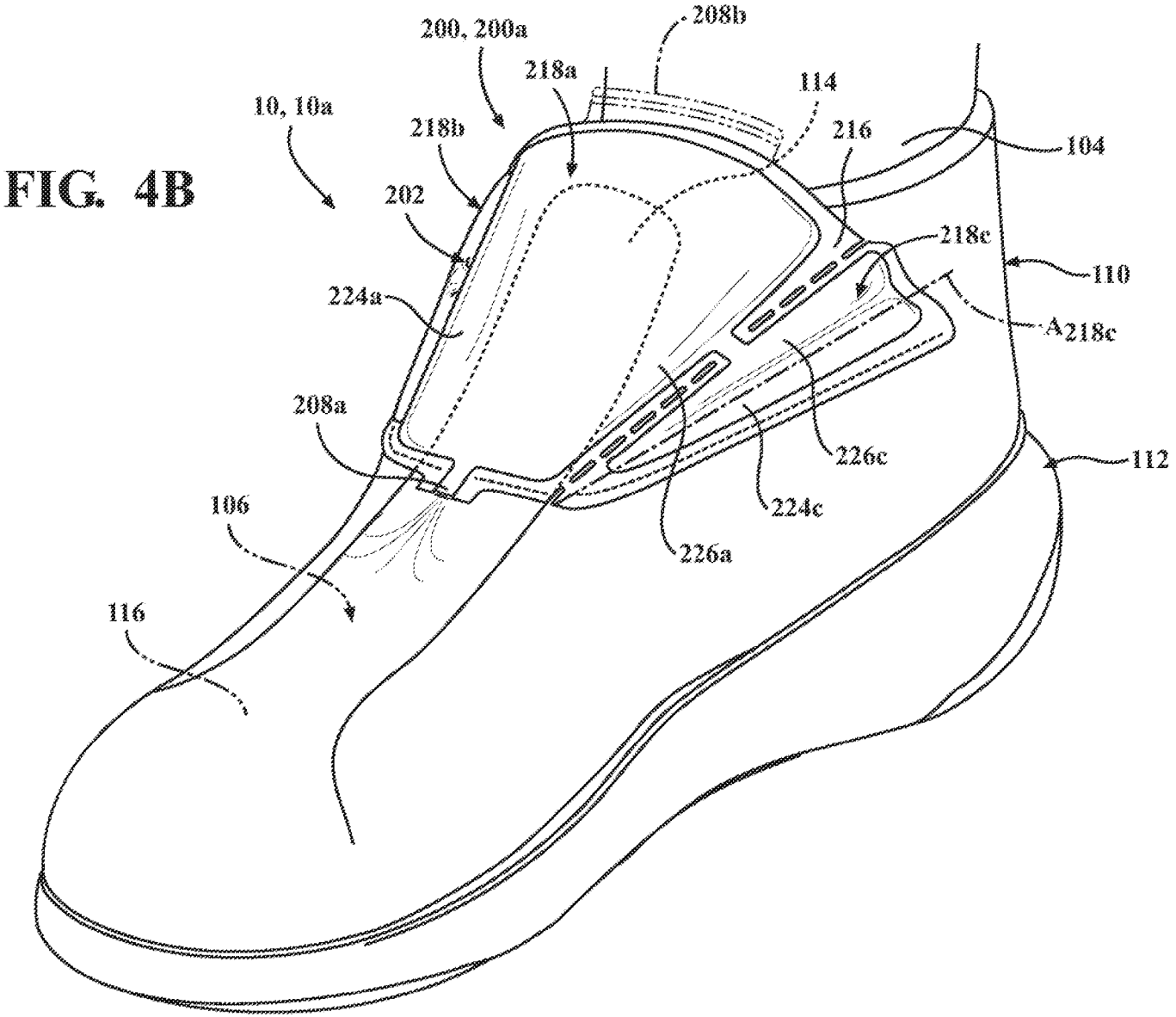
FIG. 4B is a perspective view of the article of footwear of FIG. 4A, where the adjustment element is in an intermediate configuration.
Figure 4C:
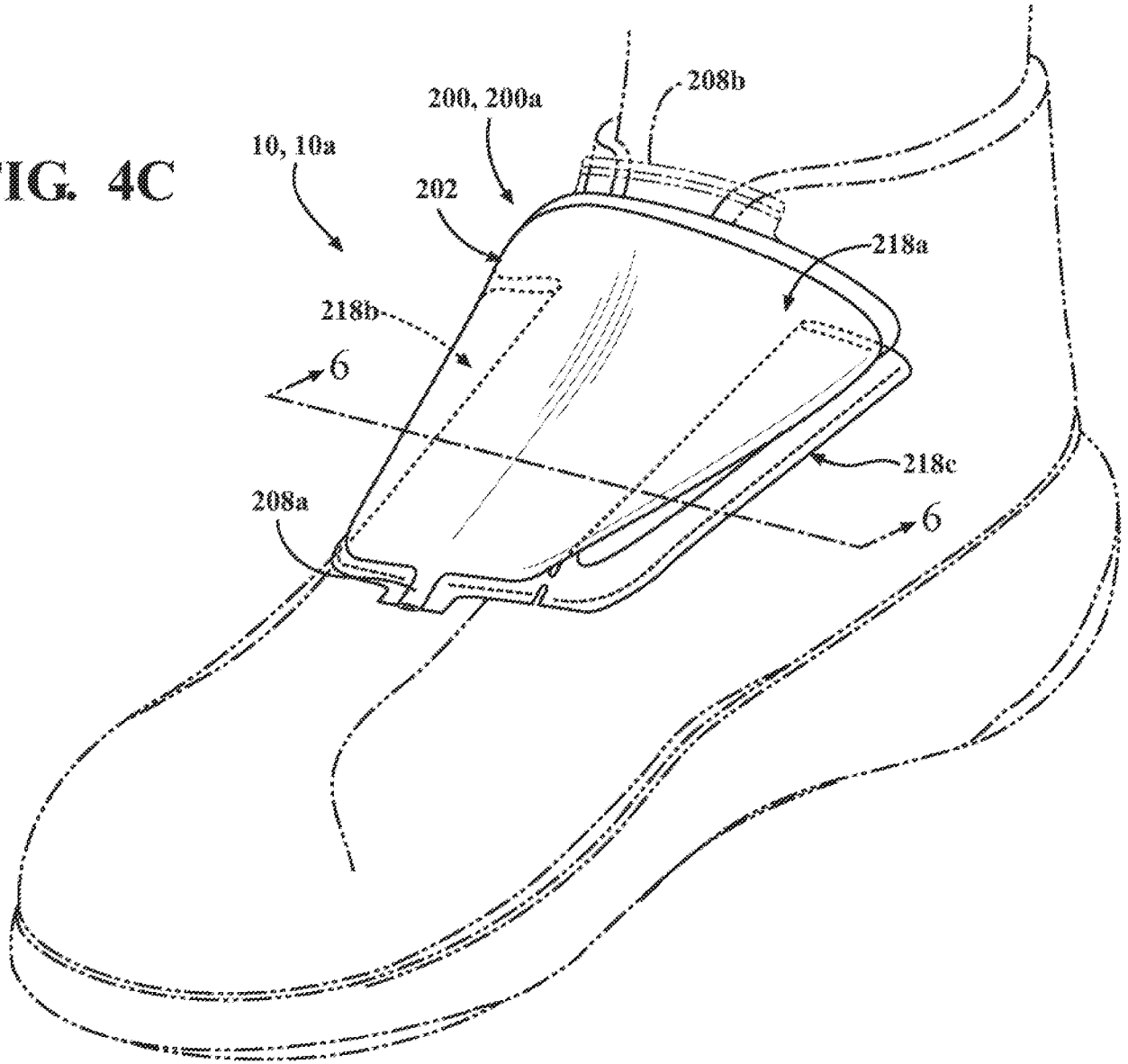
FIG. 4C is a perspective view of the article of footwear of FIG. 4A, where the adjustment element is in a contracted configuration.

Generally, the first side 224*b* of the first wing chamber 218*b* is configured to be attached to the upper 110 on a first side of the adjustment region 106 and a first side 224*c* of the second wing chamber 218*c* is configured to be attached to the upper 110 on the opposite side of the adjustment region 106 than the first wing chamber 218*b* (FIGS. 4A-4C). The central chamber 218*a* extends between and connects the second side 226*b* of the first wing chamber 218*b* and the second side 226*c* of the second wing chamber 218*c*, and is configured to span the gap of the adjustment region 106 when the wing chambers 218*b*, 218*c* are attached to the upper 110. Thus, as discussed in greater detail below with respect to FIGS. 4A-5B, the wing chambers 218*b*, 218*c* are operable to move the adjustment region 106 between a first width $W_{106-1}$ and a second width $W_{106-2}$ when the adjustment element 200, 200*a* moves between the expanded configuration (FIG. 4A) and the contracted configuration (FIG. 4C).

As shown in FIG. 1A, a width (i.e., distance between sides) of each of the chambers 218*a*-218*c* tapers from the first end 220*a*-220*c* to the second end 222*a*-222*c* such that an overall width of the adjustment element 200, 200*a* also tapers. In the illustrated example, the central chamber 218*a* is formed with a trapezoidal shape, whereby the first side 224*a* and the second side 226*a* are spaced apart from each other at the first end 220*a* and at the second end 222*a*, and converge with each other along a direction from the first end 220*a* to the second end 222*a*. The wing chambers 218*b*, 218*c* are formed as triangular structures, where the first sides 224*b*, 224*c* are spaced apart from the second sides 226*b*, 226*c* at the first ends 220*b*, 220*c* and intersect with each other at the second ends 222*b*, 222*c*. In other examples, one or more of the chambers 218*a*-218*c* may be formed with parallel or divergent sides 224*a*-224*c*, 226*a*-226*c*.

Referring to FIG. 2A, the bladder 202 may include one or more conduits 228 fluidly coupling adjacent ones of the chambers 218*a*-218*c* together. In the illustrated example, the conduits 228 are formed across a width of the seams 216 of the bladder 202, between the interior surfaces 214 of the barrier layers 210. Here, the barrier layers 210 are separated from each other along one or more portions of the seam 216 such that fluid can pass through the seam 216 and between the barrier layers 210 from one chamber 218*a*-218*c* to another.

Optionally, the seam 216 may include perforations 230 that each extend through a thickness of the seam 216 from the exterior surface 212 of one barrier layer 210 to the exterior surface 212 of the other barrier layer 210. Accordingly, the perforations 230 allow air to pass through the portions of the seam 216 between the chambers 218*a*-218*c* where the barrier layers 210 are joined to each other. Thus, the perforations 230 provide ventilation and breathability to the portion of the upper 110 disposed beneath the seam 216.

As best shown in FIG. 2A, the bladder 202 further includes a pair of bearing layers 232 disposed within the interior void 204. Each bearing layer 232 has an outer surface 234 and an inner surface 236 formed on an opposite side of the bearing layer 232 from the outer surface 234. In the illustrated example, the outer surfaces 234 of the bearing layers 232 are attached directly to the interior surfaces 214 of the barrier layers 210 such that the inner surfaces 236 of the bearing layers 232 face each other. The bearing layers 232 may be attached to the interior surfaces 214 of the barrier layers 210 by bonding the outer surface 234 of each bearing layer 232 to a respective one of the interior surfaces 214 of the barrier layers 210. Alternatively, the bearing layers 232 may be indirectly attached to the interior surfaces 214 of the barrier layers 210 by intermediate layers of material.

Generally, the bearing layers 232 are configured to provide a low-friction interface between the compressible component 206, 206*a* and the barrier layers 210. Accordingly, the bearing layers 232, or at least the inner surfaces 236 of the bearing layers 232, include a material having a lower coefficient of friction than the material forming the interior surface 214 of the barrier layers 210. In some examples, the material of the bearing layers 232 is a textile material. For example, the textile material may be a four-way stretch fabric (i.e., a material that stretches crosswise and lengthwise). Examples of suitable materials include knitted textile fabrics, Euro-woven textile fabrics, and stretchable synthetic fabrics. While the illustrated bearing layers 232 are shown as including a single layer of the material, the bearing layers 232 may optionally be formed as a laminate, whereby the outer surface 234 is formed of a first material providing desirable structural properties, such as rigidity or adhesion, and the inner surface 236 is formed of a second material providing desirable frictional properties.

Figure 2B:
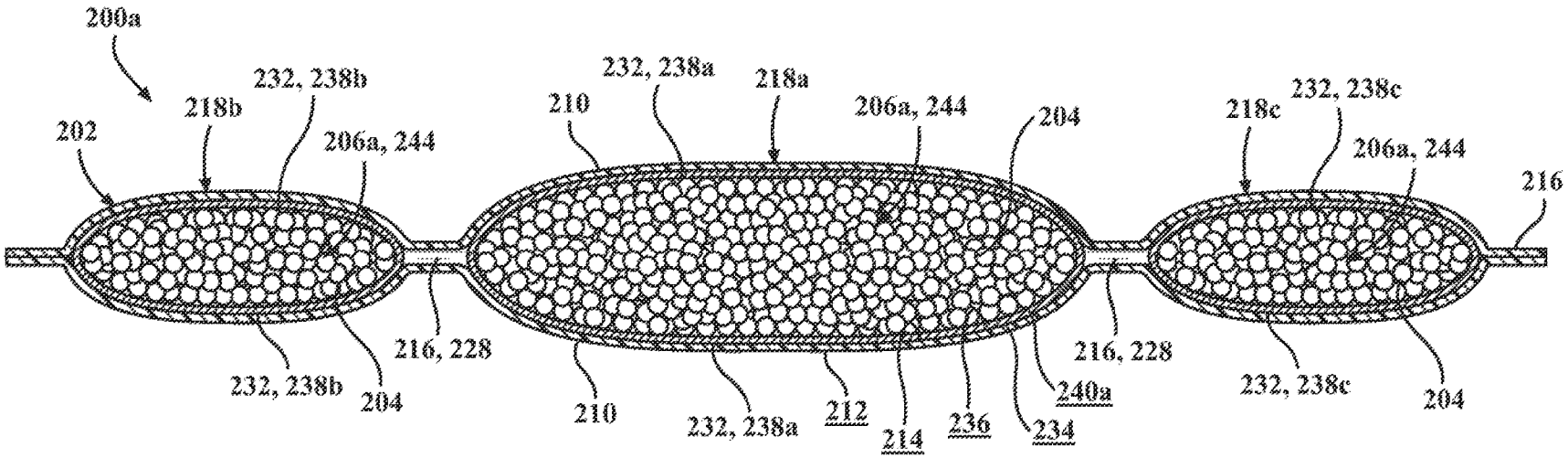

As best shown in FIGS. 2A and 2B, each of the bearing layers 232 may be separated into a plurality of fragments 238*a*-238*c* corresponding to each of the chambers 218*a*-218*c* of the bladder 202. Thus, while the barrier layers 210 are each continuously formed, the bearing layers 232 are discontinuous, such that each of the fragments 238*a*-238*c* covers a portion of the interior surface 214 of the barrier layers 210 associated with each chamber 218*a*-218*c*. The fragments 238*a*-238*c* are separated and bounded by the seams 216 of the bladder 202.

With continued reference to FIGS. 2A-3B, the compressible component 206, 206*a* is disposed between the inner surfaces 236 of the bearing layers 232 such that portions of the interior void 204 formed between the inner surfaces 236 of the bearing layers 232 are filled with the compressible component 206, 206*a*. Generally, the compressible component 206, 206*a* includes one or more resilient materials or structures configured to bias each of the chambers 218*a*-218*c* towards an expanded state. Particularly, the compressible component 206, 206*a* may include exterior surfaces 240 in facing contact with the inner surfaces 236 of the bearing layers 232, whereby a resilience of the compressible component 206, 206*a* causes the exterior surfaces 240 of the compressible component 206, 206*a* to apply a force against the inner surfaces 236 of the bearing layers 232 to bias the chambers 218*a*-218*c* towards the expanded state. As with the bearing layers 232, the compressive component 206, 206*a* may be separated into a plurality of discrete portions by the seam 216 of the bladder 202. Accordingly, each portion of the compressible component 206, 206*a* is disposed within a corresponding one of the chambers 218*a*-

218*c*, and is configured to bias the individual chamber 218*a*-218*c* towards the expanded state.

Figure 5B:
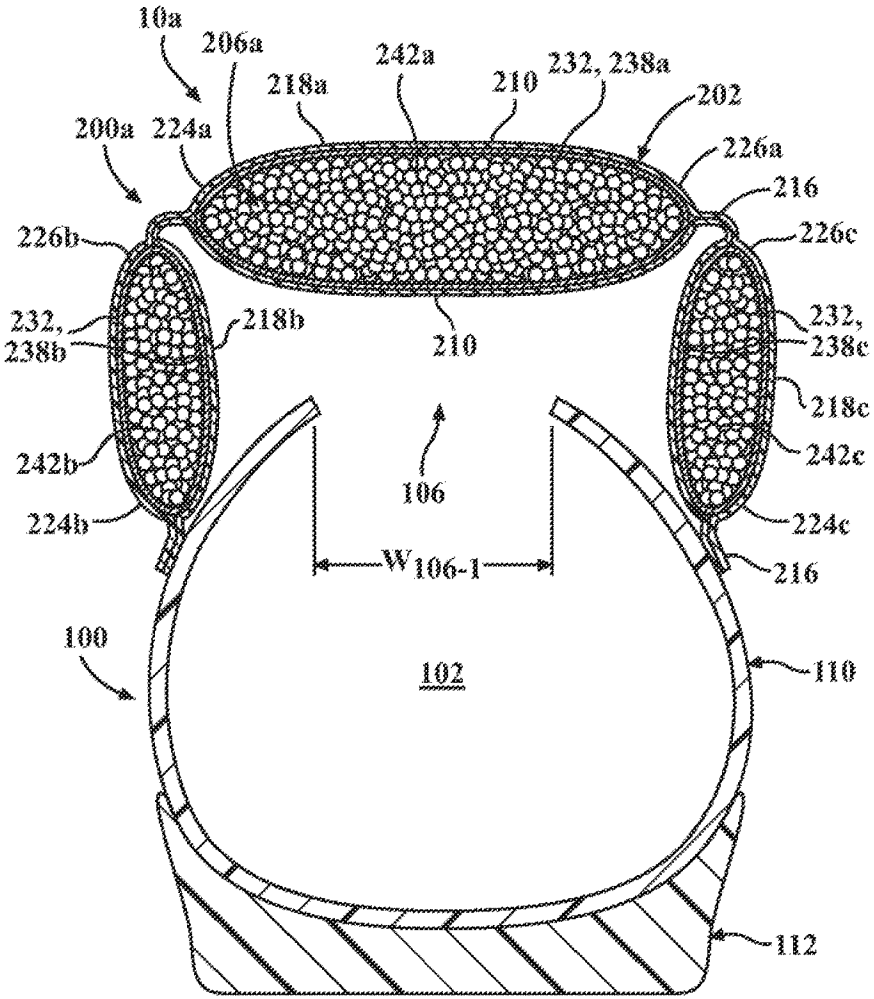
FIGS. 5A and 5B are cross-sectional views of the article of footwear of FIG. 4A, taken along section line 5-5 in FIG. 4A.
Figure 5A:
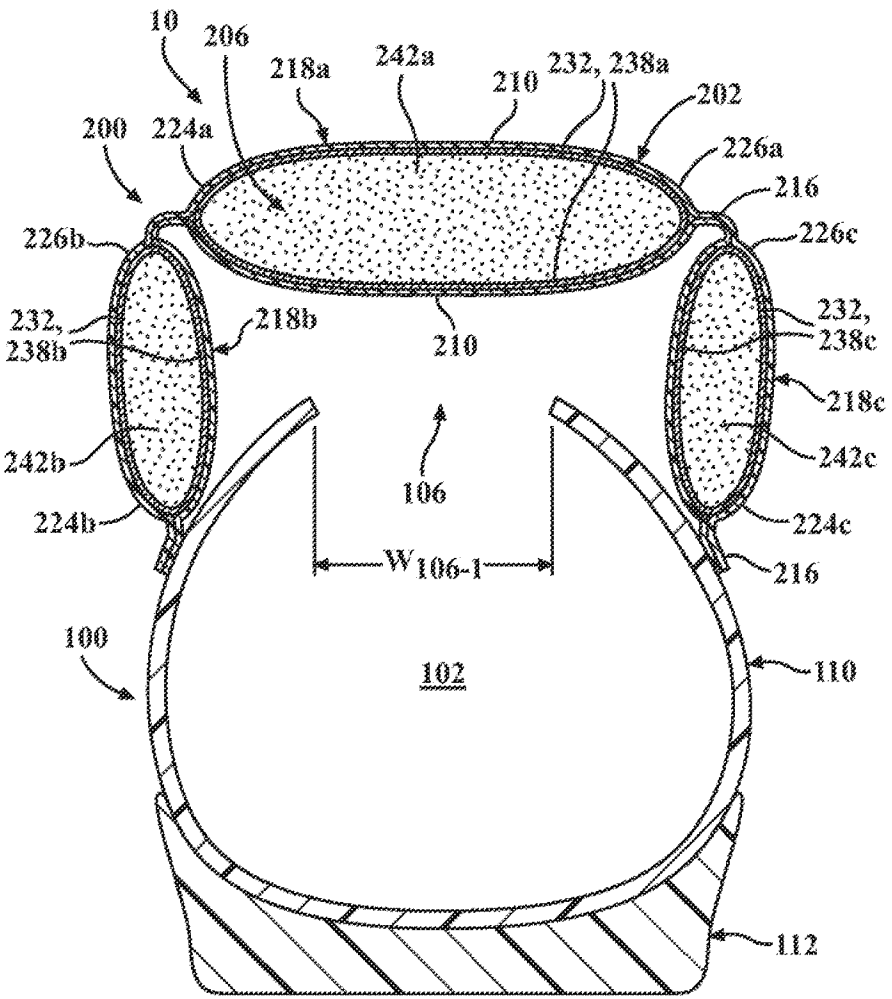
Figure 6B:
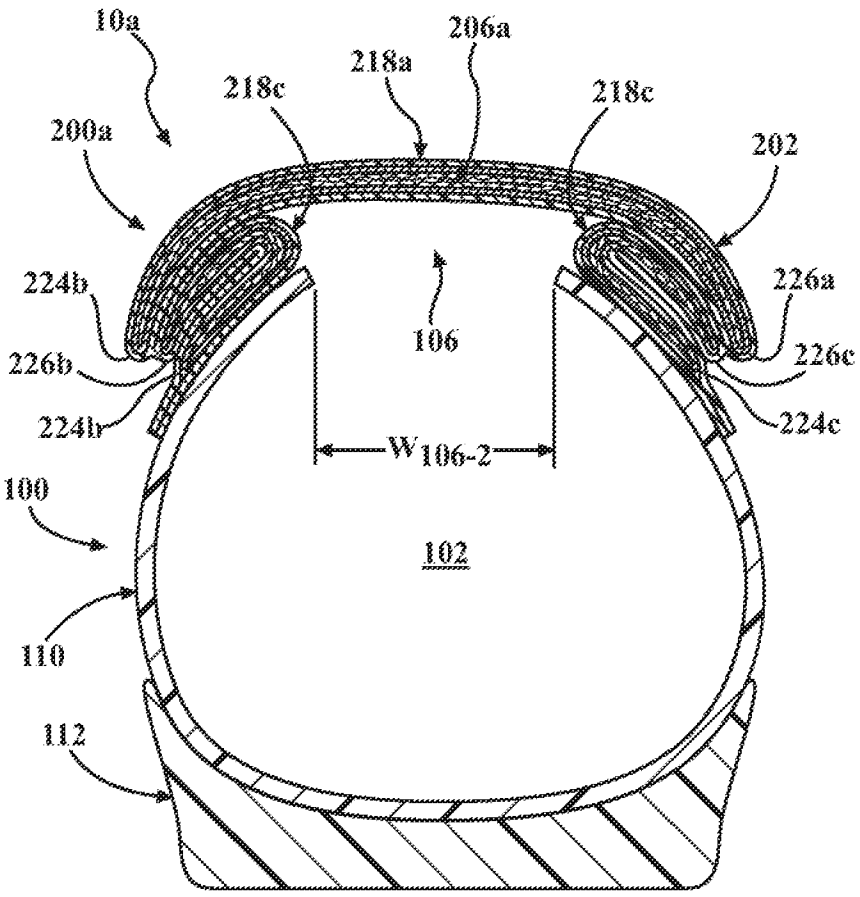
FIGS. 6A and 6B are cross-sectional views of the article of footwear of FIG. 4A, taken along section line 6-6 in FIG. 4C.

In some examples, the portions of the compressible component 206, 206*a* may include unitary compressible elements 242*a*-242*c* disposed within each of the chambers 218*a*-218*c*, as shown in FIG. 2A. The compressible elements 242*a*-242*c* are each formed of a resilient material or structure that allows a fluid to pass freely therethrough, such as an open-cell foam material. The adjustment element 200*a* of FIGS. 5B and 6B is constructed in a substantially similar manner as the adjustment element 200 described above and shown in FIGS. 5A and 6A. However, instead of being formed of a unitary material, the compressible component 206*a* may include a plurality of individual compressible particles 244, whereby each chamber 218*a*-218*c* is filled with the compressible particles 244 and the compressible particles 244 are able to move relative to each other within each chamber 218*a*-218*c*. The compressible particles may be formed of a foam material, such as a thermoplastic polyurethane (TPU) or other type of foam. In some examples, the compressible particles 244 are formed as spherical beads, and cooperate to collectively define the exterior surface 240 of the compressible component 206.

Referring again to FIG. 1A, the bladder 202 may be fitted with one or more valves 208*a*, 208*b* operable to provide fluid communication between the interior void 204 and an exterior of the bladder 202. In the illustrated example, the bladder 202 includes an exhaust valve 208*a* disposed at the second end 222*a* of the central chamber 218*a* and an intake valve 208*b* disposed at the first end 220*a* of the central chamber 218*a*. However, either one of the valves 208*a*, 208*b* may be provided on any one of the chambers 218*a*-218*c*, as the chambers 218*a*-218*c* are in fluid communication with each other through the conduits 228. In some examples, the exhaust valve 208*a* and the intake valve 208*b* may be embodied as a single valve configured for bi-directional operation as an intake valve and an exhaust valve.

The exhaust valve 208*a* is configured to be selectively opened to allow fluid to pass in a direction from the interior void 204 to an exterior of the bladder 202. In some examples, the exhaust valve 208*a* is configured as a passive valve, whereby the exhaust valve 208*a* is moved to the open position by application of a fluid pressure differential across the exhaust valve 208*a*. For example, the exhaust valve 208*a* may be configured to open when a pressure differential between an inlet side and an outlet side of the valve 208*a* satisfies or exceeds a pressure threshold. Examples of passive valves may include check valves such as duckbill valves, swing-type valves, plug-type valves, ball-type valves, and the like.

In some examples, a pressure differential may be generated by applying a positive pressure on an inlet side of the exhaust valve 208*a*. A positive pressure may be generated on the inlet side of the exhaust valve 208*a* by compressing one or more of the chambers 218*a*-218*c*, thereby forcing fluid from the interior void 204 through the exhaust valve 208*a*. Optionally, the pressure differential may be generated by applying a negative pressure on an outlet side of the valve 208*a*. For example, the outlet side of the exhaust valve 208*a* may be connected to a vacuum source, such as a pump 246. Here, the pump 246 is configured to draw a negative pressure on the outlet side of the exhaust valve 208*a* to pull fluid through the exhaust valve 208*a* from the interior void 204. While the illustrated pump 246 is shown as being disposed on the upper 110, in other examples the bladder 202 may be connected to a peripheral pump not directly incorporated into the article of apparel, such as a hand pump or a powered pump.

In the illustrated example, the intake valve 208*b* is disposed at the first end 220*a* of the central chamber 218*a* and is operable between an open position to allow a flow of fluid into the interior void 204 of the bladder 202, and a closed position to prevent a flow of fluid into the interior void 204. The intake valve 208*b* can be selectively moved between the open position and the closed position by the user. In one example, the intake valve 208*b* is embodied as a zipper that can be unsealed and resealed to open and close the intake valve 208*b*.

In addition to the passive valves 208*a*, 208*b* discussed above, either or both of the valves 208*a*, 208*b* may be embodied as an active valve configured to be manually opened and closed. For example, the valve 208*a*, 208*b* may be a manual valve that can be moved between the open position and the closed position by the wearer. In other examples, the exhaust valve 208*a*, 208*b* may be embodied as any one of the check valves discussed above, and may include a release grip connected to the valve mechanism for biasing the valve 208*a*, 208*b* to an opened position. In some examples, shape-metal alloys may be incorporated in the exhaust valve, whereby a shape of the alloy changes upon a change in temperature to move the valve 208*a*, 208*b* between the open position and the closed position.

In the example of FIGS. 4A-6B, the receptacle 100 is provided in the form of an article of footwear 100 having an upper 110 and a sole structure 112 attached to the bottom of the upper 110. Accordingly, the interior void 102, is configured to receive a foot of a wearer and the opening 104 is an ankle opening providing access into a heel region of the footwear 100. Generally, the sole structure 112 is configured to provide characteristics of cushioning and responsiveness to the article of footwear 100, while the upper 110 is configured to receive the foot of the wearer to secure the foot of the wearer to the sole structure 112.

Figure 6A:
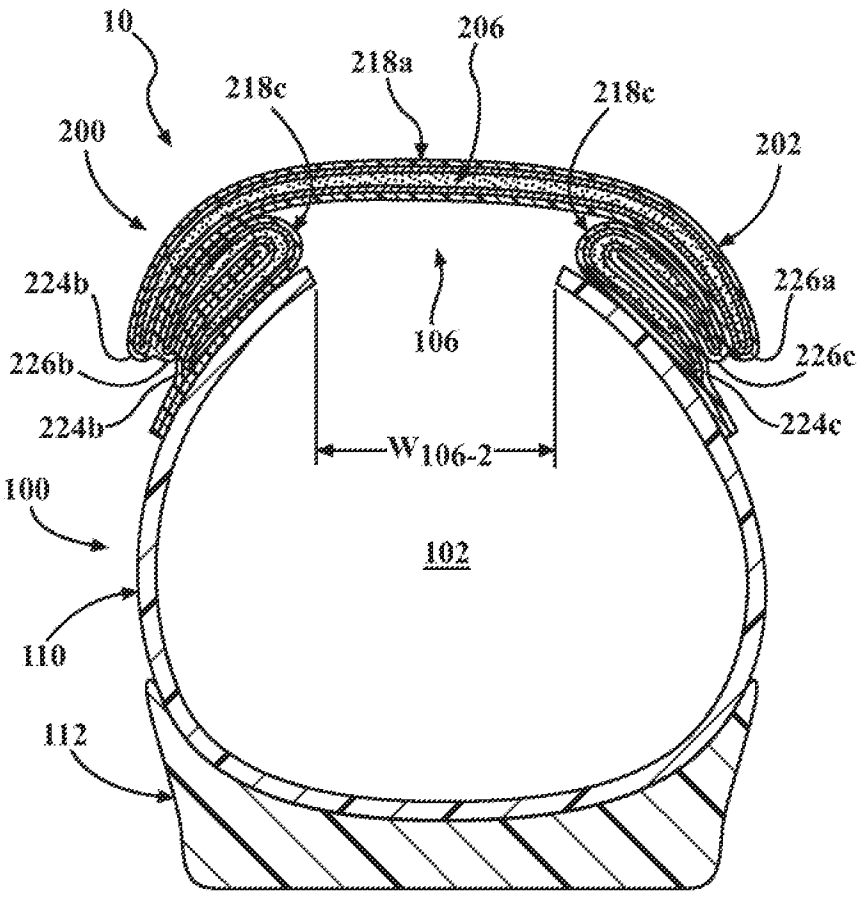

When embodied as an article of footwear 100, the adjustment region 106 of the receptacle is formed as an instep extending along a dorsal region of the upper 110 to adjust a fit of the interior void 102 around the foot, and to accommodate entry and removal of the foot therefrom. As shown, the adjustment region 106 extends from a first end 114 at the ankle opening 104 to a second end 116 spaced apart from the ankle opening 104 in a forefoot region. However, the adjustment region 106 may be formed in other areas of the upper 110, such as along a lateral side or a medial side of the upper 110. As shown in FIGS. 5A and 6A, the adjustment region 106 is formed as a gap or space through the upper 110, where a width $W_{106}$ of the gap can be increased or decreased to adjust a fit of the upper 110. Additionally or alternatively, the adjustment region 106 may include one or more elastic materials configured to move between a stretched state and a contracted state to adjust a size of the upper 110.

In the illustrated example, the first ends 220*a*-220*c* of the chambers 218*a*-218*c* are positioned adjacent to the ankle opening 104 when the adjustment element 200, 200*a* is attached to the upper 110, while the second ends 222*a*-222*c* are positioned in the midfoot region, over the adjustment region 106. The first side 224*b* of the first wing chamber 218*b* is attached to the upper 110 on a first side of the adjustment region 106 and a first side 224*c* of the second wing chamber 218*c* is attached to the upper 110 on the opposite side of the adjustment region 106 from the first wing chamber 218*b*.

Referring now to FIGS. 4A-4C, movement of the adjustment element 200, 200*a* from the expanded configuration (FIG. 4A) to the contracted configuration (FIG. 4C) is shown and described. In the expanded configuration, the interior void 204 of the bladder 202 is filled with fluid such that the interior void 204 is at a pressure equal to or greater than atmospheric pressure. As such, the compressible component 206, 206*a* is able to bias the bearing layers 232 and the barrier layers 210 outward to move each of the chambers 218*a*-218*c* to an expanded state, as shown in FIG. 5A. When each of the chambers 218*a*-218*c* is in the expanded state, the wing chambers 218*b*, 218*c* are extended, such that the first sides 224*b*, 224*c* are attached to the upper 110 and the second sides 226*b*, 226*c* are spaced apart from the first sides 224*b*, 224*c* across the wing chambers 218*b*, 218*c*. As shown, the central chamber 218*a* is spaced apart from the upper 110 by the wing chambers 218*b*, 218*c* and the adjustment region 106 has an expanded first width $W_{106\text{-}1}$. In the expanded configuration, the chambers 218*a*-218*c* are generally arranged in series with each other from the first end 224*b* of the first wing chamber 218*b* to the first end 224*c* of the second wing chamber 218*c*.

With reference to FIG. 4B, the adjustment element 200, 200*a* is transformed from the expanded configuration (FIG. 4A) to the contracted configuration (FIG. 4C) by exhausting fluid from the interior void 204 through the exhaust valve 208*a*. As discussed above, fluid may be exhausted from the interior void 204 by applying a positive pressure on the inlet side of the exhaust valve 208*a* (e.g., by squeezing or compressing the bladder 202) and/or by applying a negative pressure on the outlet side of the exhaust valve 208*a* (e.g., by using a vacuum pump). As fluid is exhausted from the interior void 204, the compressible component 206, 206*a* is compressed within the interior void 204 by the barrier layers 210. The pressure exerted on the adjustment element 200, 200*a* may be applied directly to an outer surface of the adjustment element 200, 200*a* by a wearer depressing the adjustment element 200, 200*a* either directly (i.e., with the wearer's hand) or indirectly by constricting laces (not shown) that extend at least partially over the adjustment element 200, 200*a*.

Referring now to FIG. 4C, the adjustment element 200, 200*a* is moved to the fully compressed configuration. Here, each of the chambers 218*a*-218*c* is in a fully-compressed state, such that the pores or cells of the material forming the compressible component 206, 206*a* are substantially fully collapsed. When the chambers 218*a*-218*c* are in the fully-compressed state, the resiliency of the compressible component 206, 206*a* causes the exterior surface 240 of the compressible component 206, 206*a* to apply an outward biasing force against the inner surface 236 of the bearing layers 232, and consequently, to the barrier layers 210. However, because the exhaust valve 208*a* is configured to prevent fluid flow into the interior void 204, the chambers 218*a*-218*c* are prevented from returning to their respective expanded states. Instead, the biasing force of the compressible component 206, 206*a* against the barrier layers 210 of the bladder 202 causes a vacuum (i.e., negative pressure) to form within the interior void 204 to maintain the chambers 218*a*-218*c* in the compressed states.

When the chambers 218*a*-218*c* are in the compressed states, the chambers 218*a*-218*c* can be folded over upon themselves to reduce an effective width of the adjustment element 200, 200*a*. For example, as illustrated in FIGS. 4C and 6A, the wing chambers 218*b*, 218*c* may be folded along their respective longitudinal axes $A_{218b}$, $A_{218c}$. Accordingly, the second side 226*b*, 226*c* of each wing chamber 218*b*, 218*c* is folded over upon the first side 224*b*, 224*c* of the respective wing chamber 218*b*, 218*c*. Consequently, the first side 224*a* of the central chamber 218*a* and the first side 224*b* of the first wing chamber 218*b* are pulled towards each other, while the second side 226*a* of the central chamber 218*a* and the first side 224*c* of the second wing chamber 218*c* are pulled towards each other. As shown in FIGS. 4C and 6A, when the wing chambers 218*b*, 218*c* are folded along their longitudinal axes $A_{218b}$, $A_{218c}$, the wing chambers 218*b*, 218*c* will be folded beneath the central chamber 218*a*. Furthermore, the reduction in the effective width of the adjustment element 200, 200*a* causes the adjustment region 106 to be contracted to the second width $W_{106\text{-}2}$ that is less than the first width $W_{106\text{-}1}$, thereby tightening the upper 110 around the foot of the wearer.

To return the adjustment element 200, 200*a* to the expanded configuration, the intake valve 208*b* is moved to an open position to allow fluid to flow into the interior void 204 of the bladder 202. Particularly, with the intake valve 208*b* in the open position, the resiliency of the compressible component 206, 206*a* biases the barrier layers 210 outwardly to increase the volume of the interior void, thereby drawing fluid through the intake valve 208*b* until the compressible component 206, 206*a* reaches a fully-expanded state. In some examples, the fluid flow through the intake valve 208*b* may be metered so as to only allow the compressible component 206, 206*a* to move to a partially-expanded state. The partially-expanded state may be used where a looser fit of the upper 110 on the foot is desired.

With particular reference to FIGS. 7A-10B, additional examples of configurations of adjustment elements 200*b*, 200*c* are shown. In view of the substantial similarity in structure and function of the components associated with the adjustment elements 200 with respect to the adjustment elements 200*b*, 200*c*, like reference numerals are used hereinafter and in the drawings to identify like components while like reference numerals containing letter extensions are used to identify those components that have been modified.

As with the adjustment element 200 described above, the adjustment elements 200*b*, 200*c* of FIGS. 7A-9B include a bladder 202*a* having a pair of barrier layers 210 joined together at discrete locations to define a seam 216*a* and a plurality of chambers 218*d*-218*j*. The bladder 202*a* extends along and is substantially symmetrical about a longitudinal axis $A_{202a}$ and includes a first series of chambers 218*d*-218*j* arranged on a first (e.g., lateral) side of the longitudinal axis $A_{202a}$ and a second series of chambers 218*d*-218*j* arranged on a second (e.g., medial) side of the longitudinal axis $A_{202a}$. The chambers 218*d*-218*j* are generally elongate and extend longitudinally from a first end 220*d*-220*j* to a second 222*d*-222*j*.

As shown, the chambers 218*d*-218*j* in each series are orientated at an oblique angle relative to the longitudinal axis $A_{202a}$. Particularly, a length of each of the chambers 218*d*-218*j* extends along a direction from the first end 220*d*-220*j* spaced apart from the longitudinal axis $A_{202a}$ to the second end 222*d*-222*j* adjacent to the longitudinal axis $A_{202a}$. Put another way, each of the chambers 218*d*-218*j* extends along a direction of the longitudinal axis $A_{202a}$ and diverges from the longitudinal axis $A_{202a}$ along a direction from the second end 222*d*-222*j* to the first end 220*d*-220*j*. The chambers 218*d*-218*j* in each series may be arranged parallel to each other. Accordingly, the first series of chambers 218*d*-218*j* on the first side of the longitudinal axis $A_{202a}$ all diverge from the chambers 218*d*-218*j* of the second series on the second side of the longitudinal axis $A_{202a}$. In other examples, the chambers 218*d*-218*j* may be non-parallel, or may be arranged as an array of chambers.

Figure 8A:
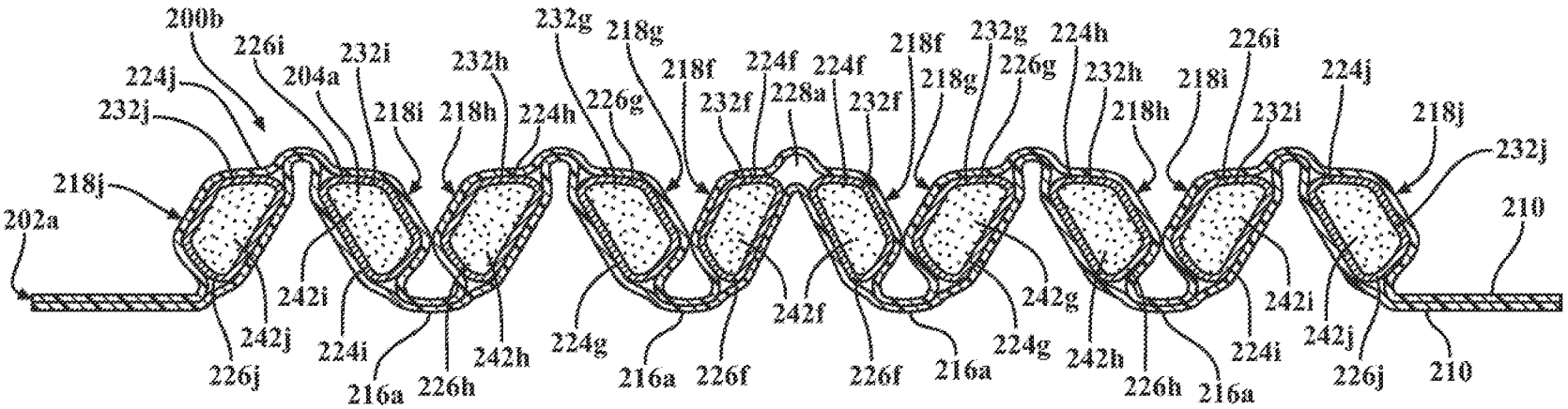
FIGS. 8A and 8B are cross-sectional views of the adjustment element of FIG. 7A, taken at section line 8-8 in FIG. 7A.
Figure 9A:
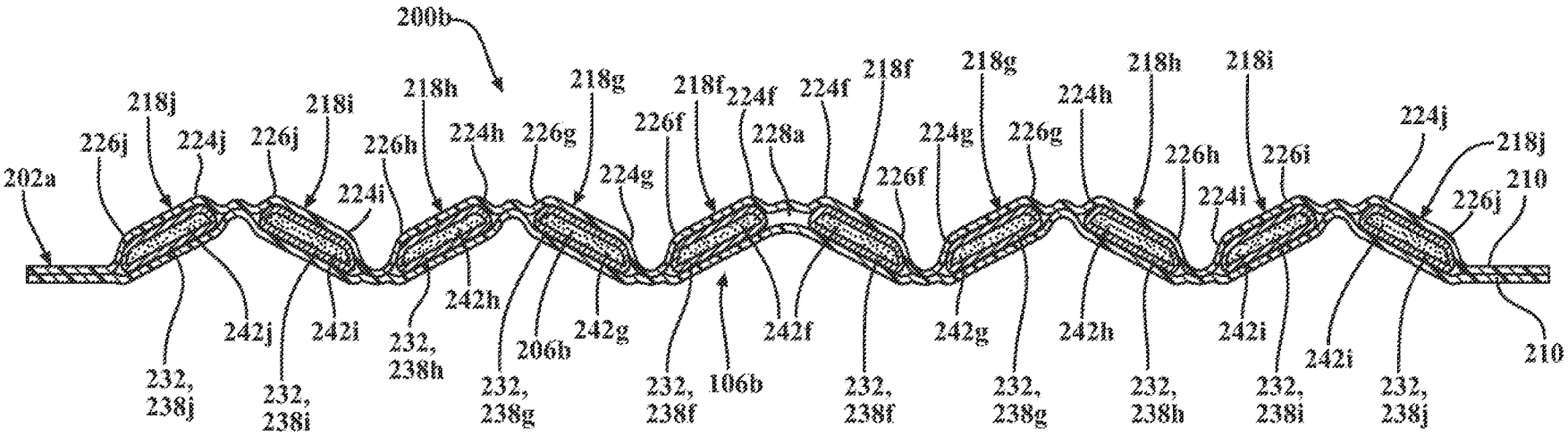
FIGS. 9A and 9B are cross-sectional views of the adjustment element of FIG. 7A, taken at section line 9-9 in FIG. 7B.

With continued reference to FIGS. 8A and 9A, each of the chambers 218*d*-218*j* further includes a first side 224*d*-224*j* and a second side 226*d*-226*j* formed on an opposite side of the chamber 218*d*-218*j* than the first side 224*d*-224*j*. Here, each of the first side 224*d*-224*j* and the second side 226*d*-226*j* extends from the first end 220*d*-220*j* to the second end 222*d*-222*j* along the length of the respective chamber 218*d*-218*j*. For each series of chambers, 218*d*-218*j*, the first side 224*d*-224*j* faces inwardly towards the longitudinal axis $A_{202a}$, while the second side 226*d* faces outwardly away from the longitudinal axis $A_{202a}$. The first side 226*d*-226*j* of each chamber 218*d*-218*j* attaches to the second side 226*d*-226*j* of an adjacent one of the chambers 218*d*-218*j* along the seam 216*a* of the bladder 202*a*.

Like the bladder 202 discussed above, the bladder 202*a* of FIGS. 7A and 7B includes one or more conduits 228*a* fluidly coupling each of the chambers 218*d*-218*j* together. As best illustrated in FIGS. 8A and 9A, the conduit 228*a* of the bladder 202*a* may be configured as a central manifold extending continuously along the longitudinal axis $A_{202a}$ and connecting the second ends 222*d*-222*j* of each of the chambers 218*d*-218*j*. Accordingly, each of the chambers 218*d*-218*j* is in communication with each other through the conduit 228*a*, as shown in FIGS. 7A and 7B.

The bladder 202*a* may include one or more valves 208*c*, 208*d* in communication with the interior void 204*a* of the bladder 202*a* and configured to selectively allow a flow of fluid into and/or out of the bladder 202*a*. In the illustrated example, the bladder 202*a* includes a pair of exhaust valves 208*c* disposed on opposite sides of the bladder 202*a*. For example, a first exhaust valve 208*c* is disposed on the first side of the bladder 202*a* and is in direct fluid communication with an outermost one of the chambers 218*j* on the first side, while a second exhaust valve 208*c* is disposed on the second side of the bladder 202*a* and is in direct fluid communication with an outermost one of the chambers 218*j* on the second side.

The bladder 202*a* further includes an intake valve 208*d* disposed at one end. As shown, the intake valve 208*d* is disposed along the longitudinal axis $A_{202a}$ and is in direct fluid communication with the conduit 228*a*. While the intake valve 208*d* is shown as being positioned adjacent to the first ends 220*d*-220*j* of the chambers 218*d*-218*j*, the intake valve 208*d* may be positioned adjacent to the second ends 222*d*-222*j* of the chambers 218*d*-218*j*. Additionally or alternatively, one or more intake valves 208*d* may be fluidly coupled directly to one of the chambers 218*d*-218*j* in a similar manner as the exhaust valves 208*c*.

Figure 7A:
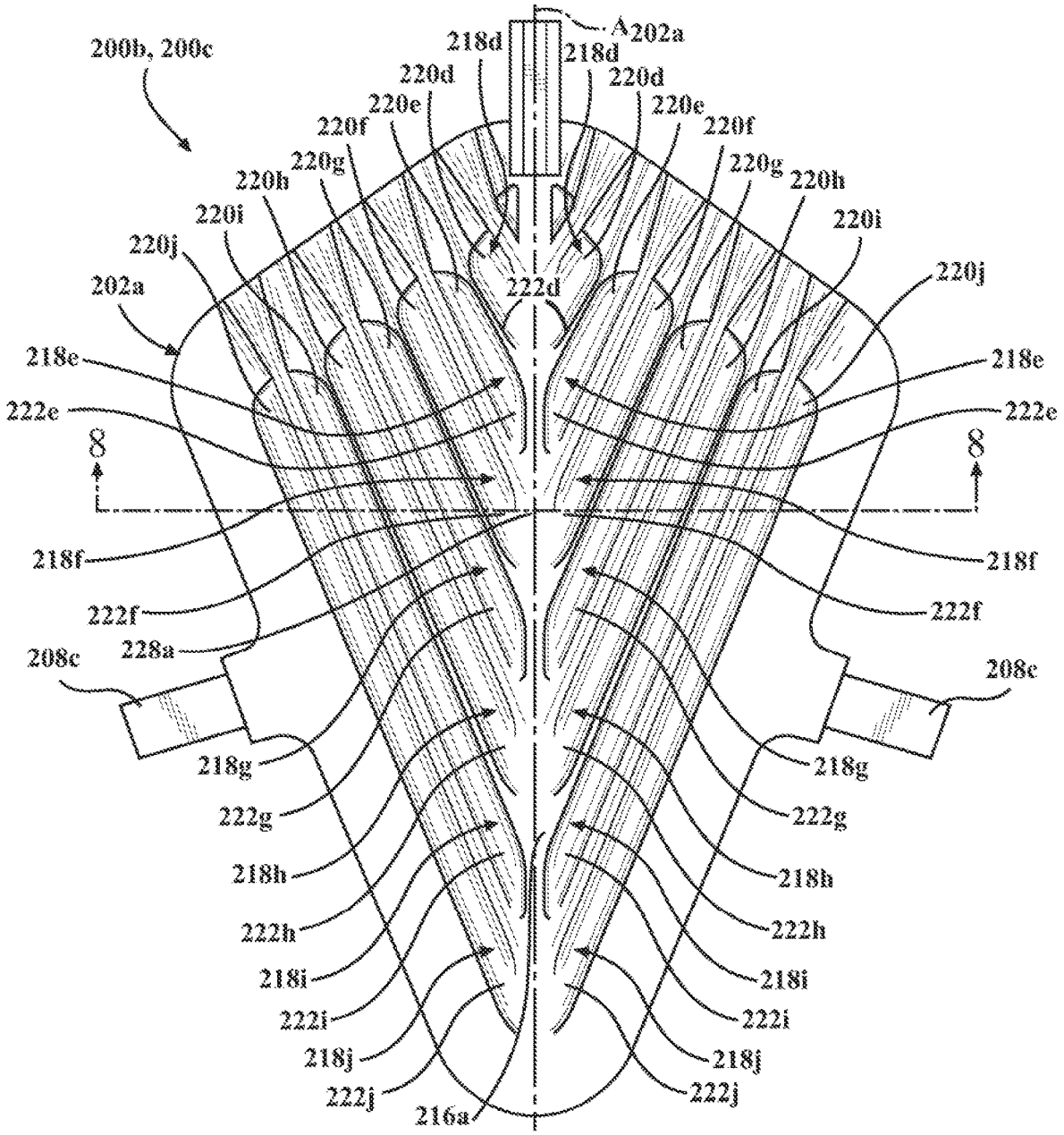
FIG. 7A is a top plan view of an adjustment element according the principals of the present disclosure, where the adjustment element is in a contracted configuration.
Figure 7B:
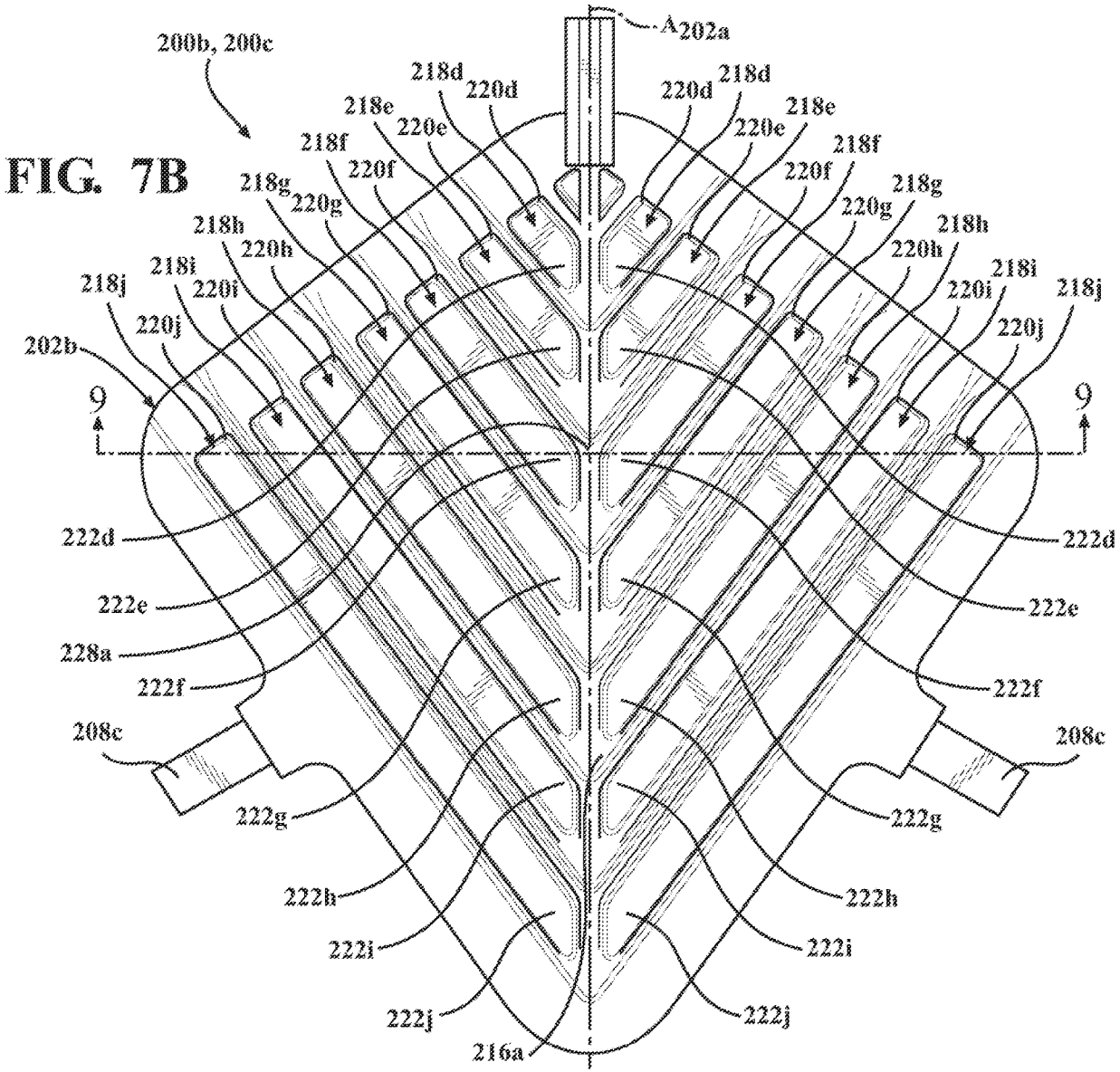
FIG. 7B is a top plan view of the adjustment element of FIG. 7A, where the adjustment element is in an expanded configuration.

Referring to FIGS. 8A-9B, the adjustment element 200*b*, 200*c* of FIGS. 7A and 7B are constructed in a similar fashion as the adjustment element 200, 200*a* described above. Particularly, the adjustment element includes the barrier layers 210 joined to each other along the seam 216*a* to define a profile of the interior void 204*a* and to form the plurality of chambers 218*d*-218*j*. The bladder 202*a* further includes one or more bearing layers 232 attached to opposing interior surfaces 214 of the barrier layers 210, where the bearing layers 232 are subdivided into a plurality of fragments 238*d*-238*j* corresponding to portions of the interior surface 214 forming each chamber 218*d*-218*j*. A compressible component 206*b*, 206*c* is disposed within the interior void 204*a*.

With reference to FIGS. 8A and 9A, in one example the adjustment element 200*b* may be formed with a compressible component 206*b* including a plurality of unitary compressible elements 242*d*-242*j* filling a portion of the interior void 204*b* defined by each of the chambers 218*d*-218*j*. In another example of the adjustment element 206*c*, each of the chambers 218*d*-218*j* may be filled with the compressible particles 244 discussed above.

In use, the adjustment elements 200*b*, 200*c* of FIGS. 7A-9B move between a contracted configuration (FIG. 7A) and an expanded configuration (FIG. 7B) by changing a fluid pressure within the interior void 204*a* of the bladder 202*a*. However, unlike the bladder 202 discussed above, the bladder 202*a* of FIGS. 7A-9B moves to the contracted configuration when fluid pressure within the interior void 204*a* is equal to or greater than atmospheric pressure, and moves to the expanded configuration when the fluid pressure within the interior void 204*a* is less than atmospheric pressure.

Figure 8B:
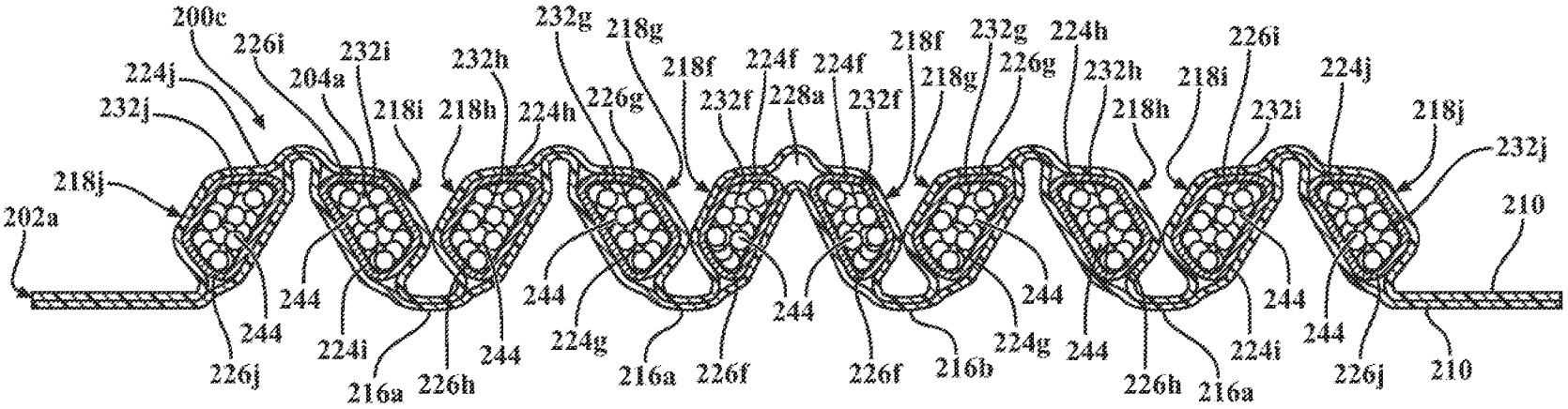

With particular reference to FIGS. 7A, 8A, and 8B, the adjustment element 200*b*, 200*c* is shown in the contracted configuration. Here, the fluid pressure within the interior void 204*a* of the bladder 202*a* is equal to or greater than atmospheric pressure such that the compressible component 206*b*, 206*c* is able to bias the barrier layers 210 of the bladder 202*a* apart to move the chambers 218*d*-218*j* to an expanded state. In the expanded state, thicknesses (i.e., the distance between the exterior surfaces 212 of the barrier layers 210) of the chambers 218*d*-218*j* are maximized, while the widths (i.e., distance between the first side 224*d*-224*j* and the second side 226*d*-226*j*) are minimized. Accordingly, adjacent ones of the chambers 218*d*-218*j* are drawn towards each other as the barrier layers 210 are biased apart from each other, thereby causing an overall width (i.e., distance across all chambers 218*d*-218*j*) of the bladder 202*a* to be minimized.

Figure 9B:
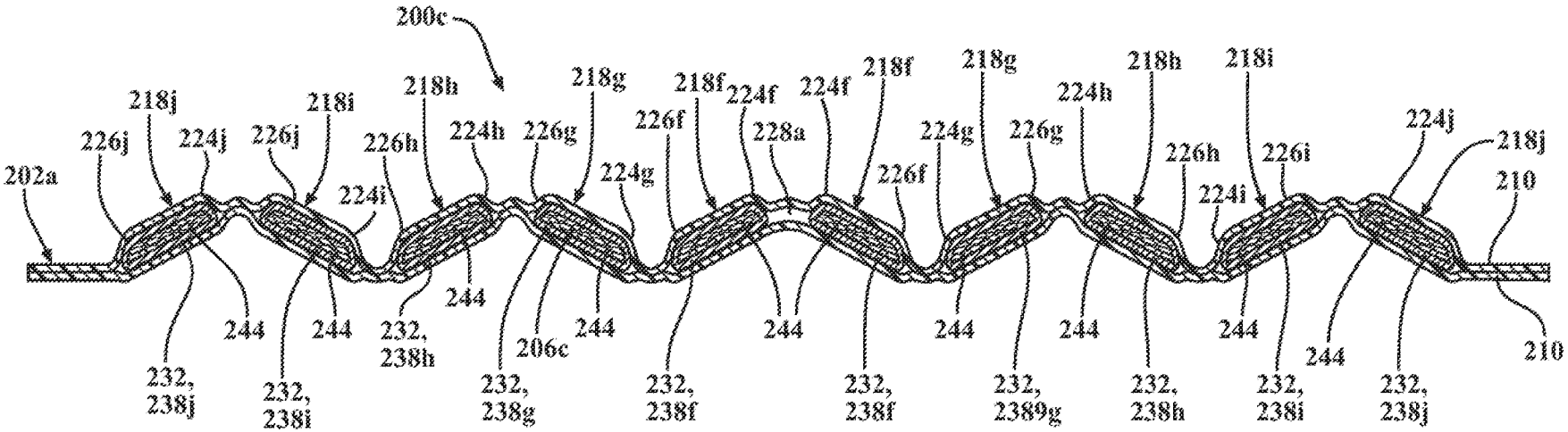

Referring to FIGS. 7B, 9A, and 9B, to move the adjustment element 200*b*, 200*c* to the expanded configuration, a fluid pressure within the interior void 204*a* is reduced below the atmospheric pressure such that the barrier layers 210 are drawn towards each other to minimize the thicknesses of the chambers 218*d*-218*j*. As discussed above, fluid pressure is reduced by removing a volume of fluid from the interior void 204*a*. This may be accomplished by compressing (e.g., squeezing) the chambers—either directly or indirectly (i.e., via laces)—to create a positive pressure on an inlet side of the exhaust valves 208*c*, thereby causing fluid to be forced through the exhaust valves 208*c* and out of the bladder 202*a*. Additionally or alternatively, fluid may be removed by applying a vacuum to an outlet side of the vacuum valves 208*c*.

Once the fluid exits the interior void 204*a*, the resiliency of the compressible component 206*b*, 206*c* applies a biasing force to the bearing layers 232 of the bladder to bias the barrier layers 210 apart from each other. However, with the pressure differential removed, the exhaust valves 208*c* move to a closed position to prevent fluid flow into the interior void. Thus, the biasing force of the compressible component 206*b*, 206*c* generates a negative pressure within the interior void 204*a*, which maintains the chambers 218*d*-218*j* in the compressed state.

As shown in FIGS. 9A and 9B, when the chambers 218*d*-218*j* are in the compressed state, a thickness of the chambers 218*d*-218*j* is minimized and the widths of the chambers 218*d*-218*j* are maximized. Furthermore, moving the chambers 218*d*-218*j* to the compressed state allows the seam 216*a* of the bladder 202*a* to move to a relaxed state between adjacent ones of the chambers 218*d*-218*h*, as the transition from joined barrier layers 210 of the seam 216*a* to the separated barrier layers 210 of each chamber 218*d*-218*j* is more gradual. With the chambers 218*d*-218*j* in the compressed state, an overall width of the bladder 202*a* is maximized.

Figure 10A:
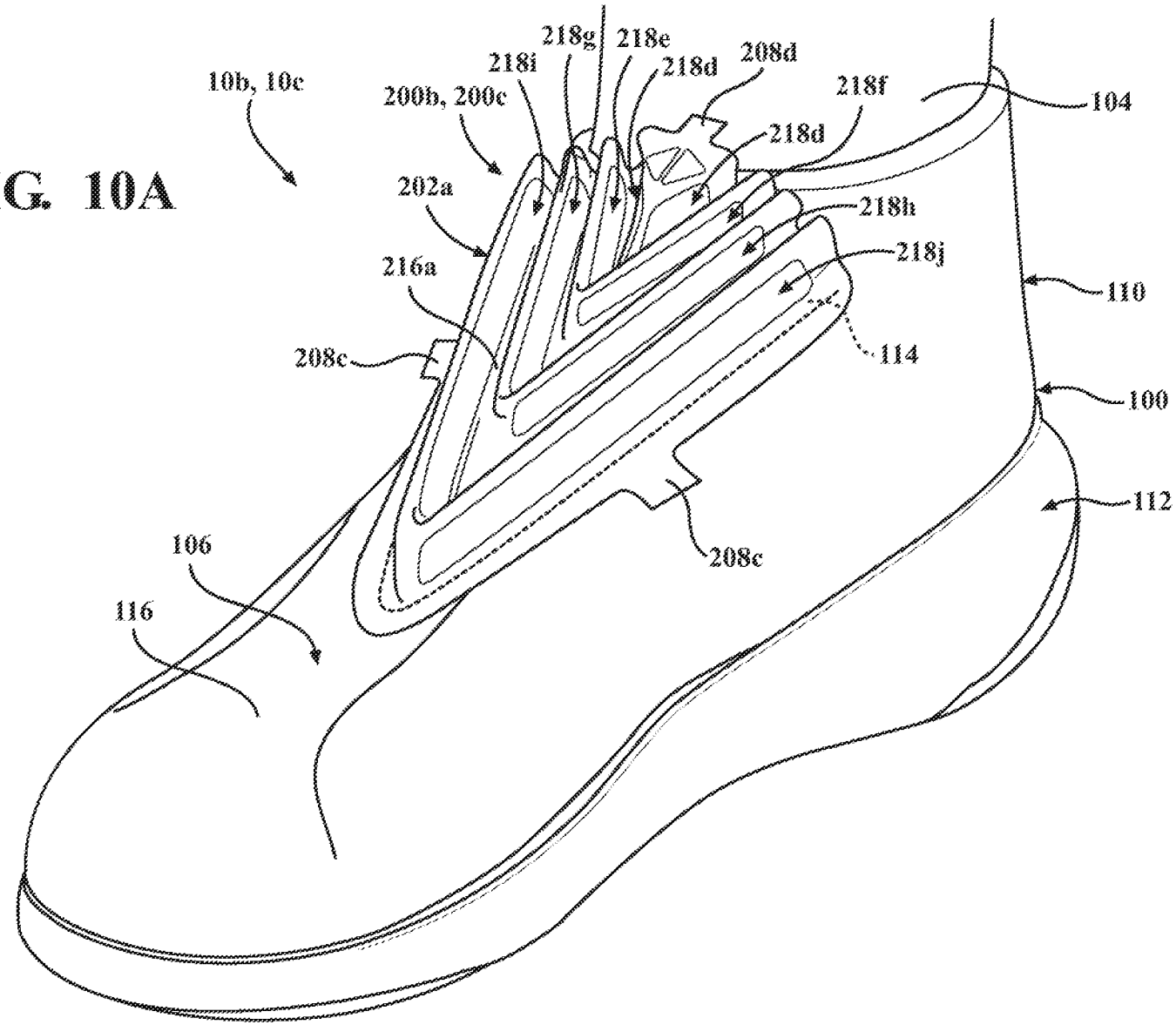
FIG. 10A is a perspective view of an article of footwear incorporating the adjustment element of FIG. 7A, where the adjustment element is in the contracted configuration.
Figure 10B:
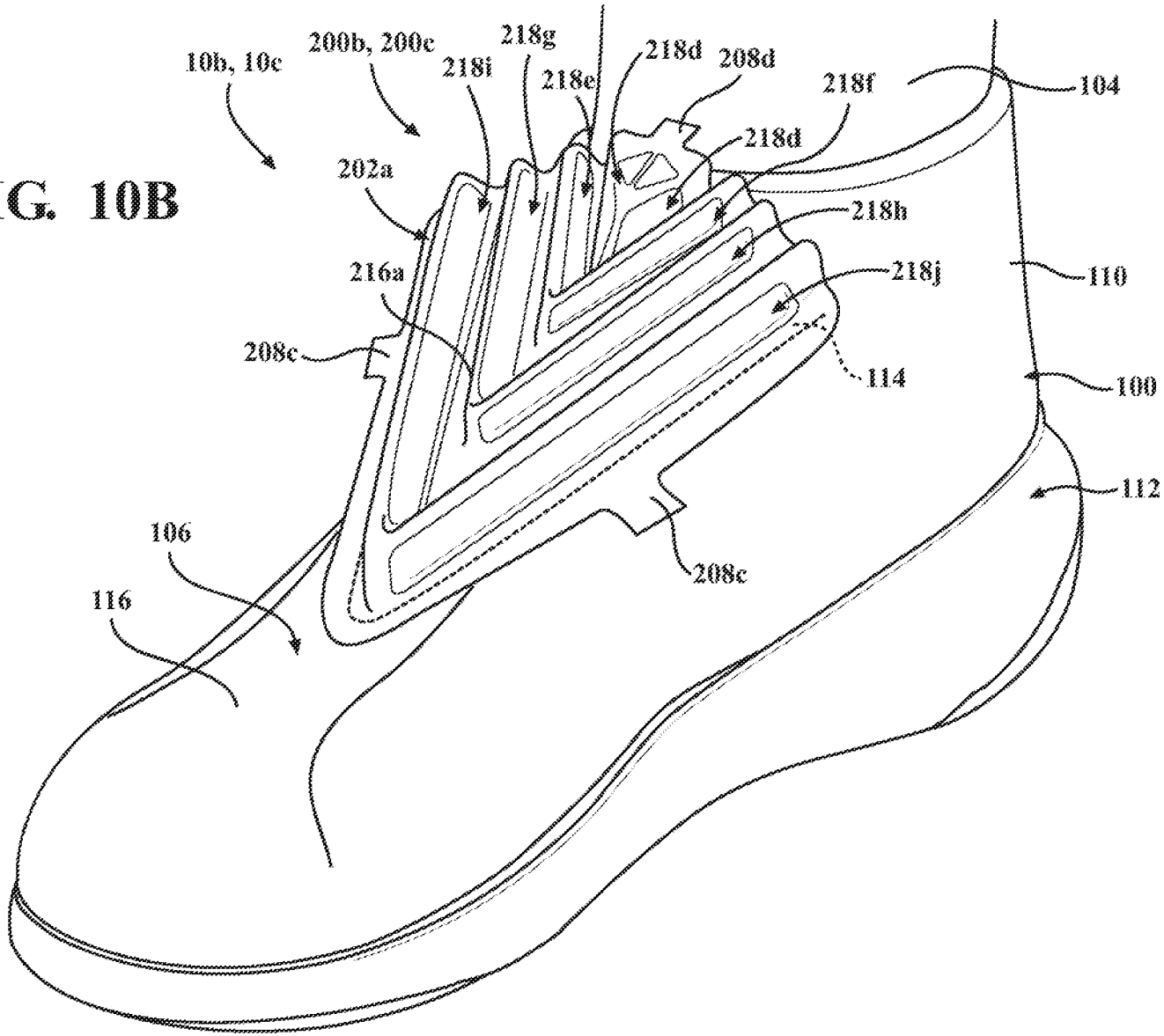
FIG. 10B is a perspective view of the article of footwear of FIG. 10A, where the adjustment element is in an intermediate configuration.
Figure 10C:
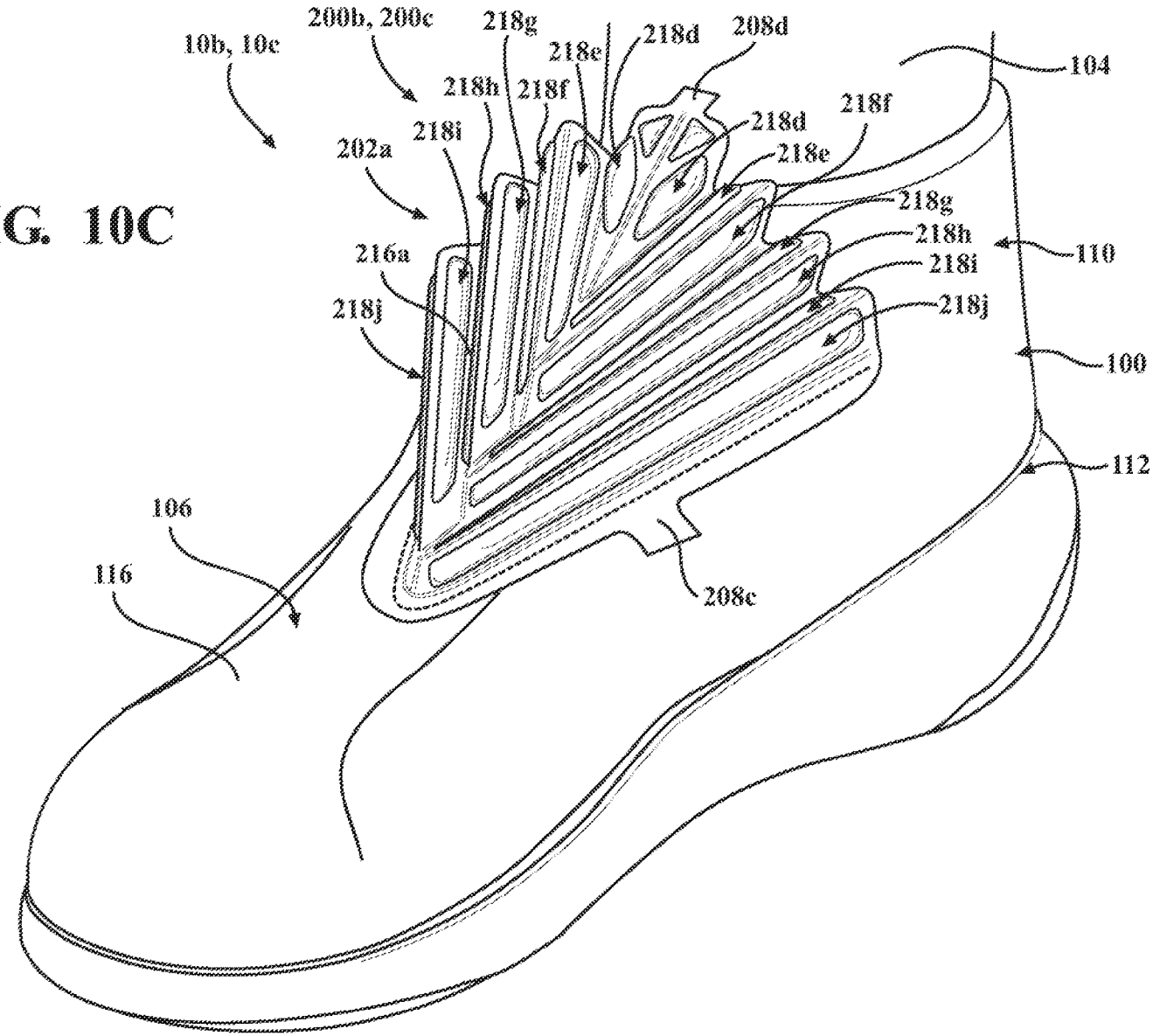
FIG. 10C is a perspective view of the article of footwear of FIG. 10A, where the adjustment element is in the expanded configuration.

With reference to FIGS. 10A and 10B, in one example, the adjustment element 200*b*, 200*c* is incorporated on an article of footwear 100. Similar to the article 10, 10*a* discussed above, here the article 10*b*, 10*c* includes the article of footwear 100 having the adjustment region 106 disposed in an instep region adjacent to an ankle opening 104. To adjust a fit of the article of footwear 100, the adjustment element 200*b*, 200*c* is moved between the contracted configuration (FIG. 10A) and the expanded configuration (FIG. 10B) by changing the fluid pressure within the interior void 204*a* of the bladder 202*a*.

Figure 11A:
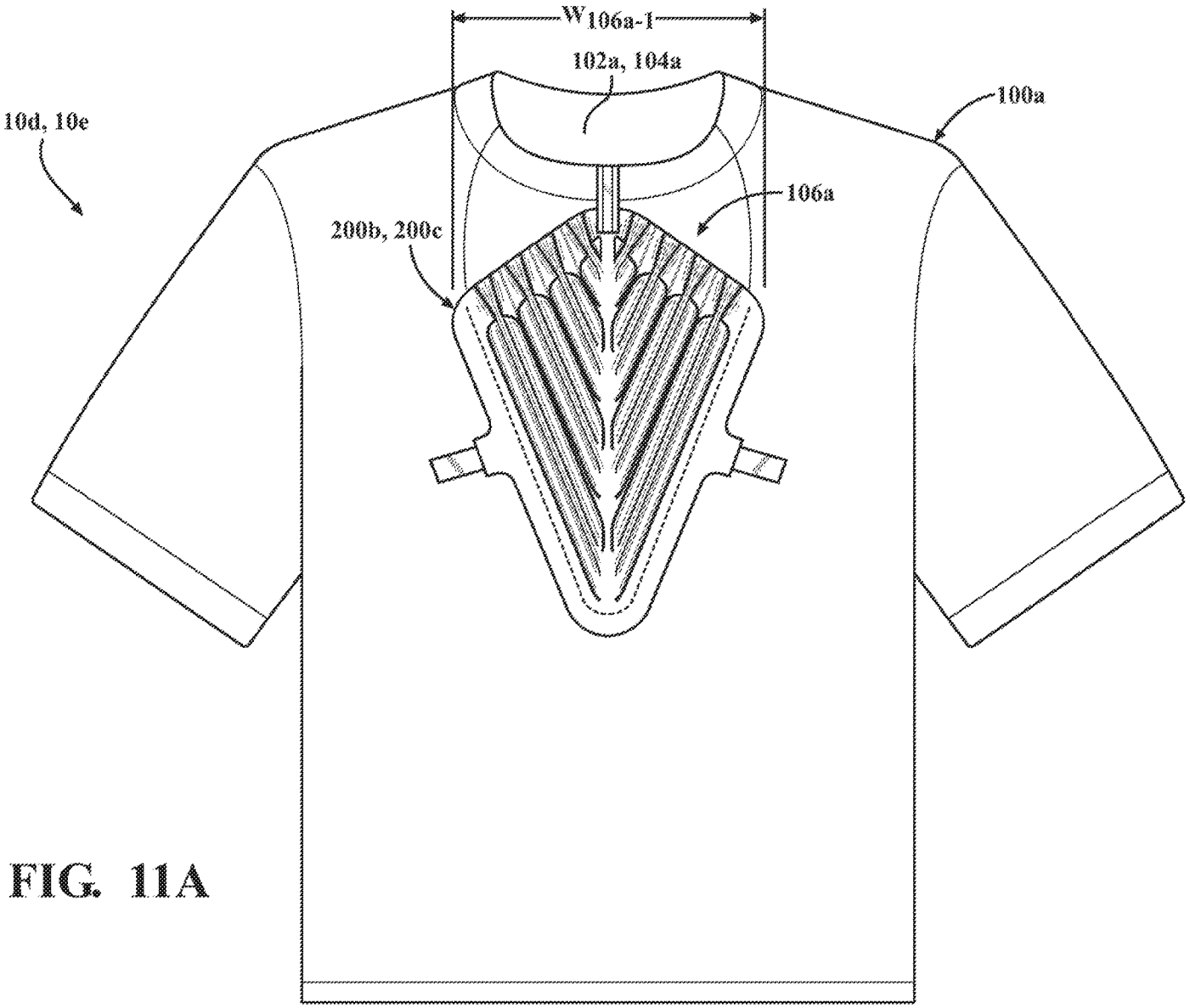
FIG. 11A is an elevation view of a garment incorporating the adjustment element of FIG. 7A, where the adjustment element is in the contracted configuration.
Figure 11B:
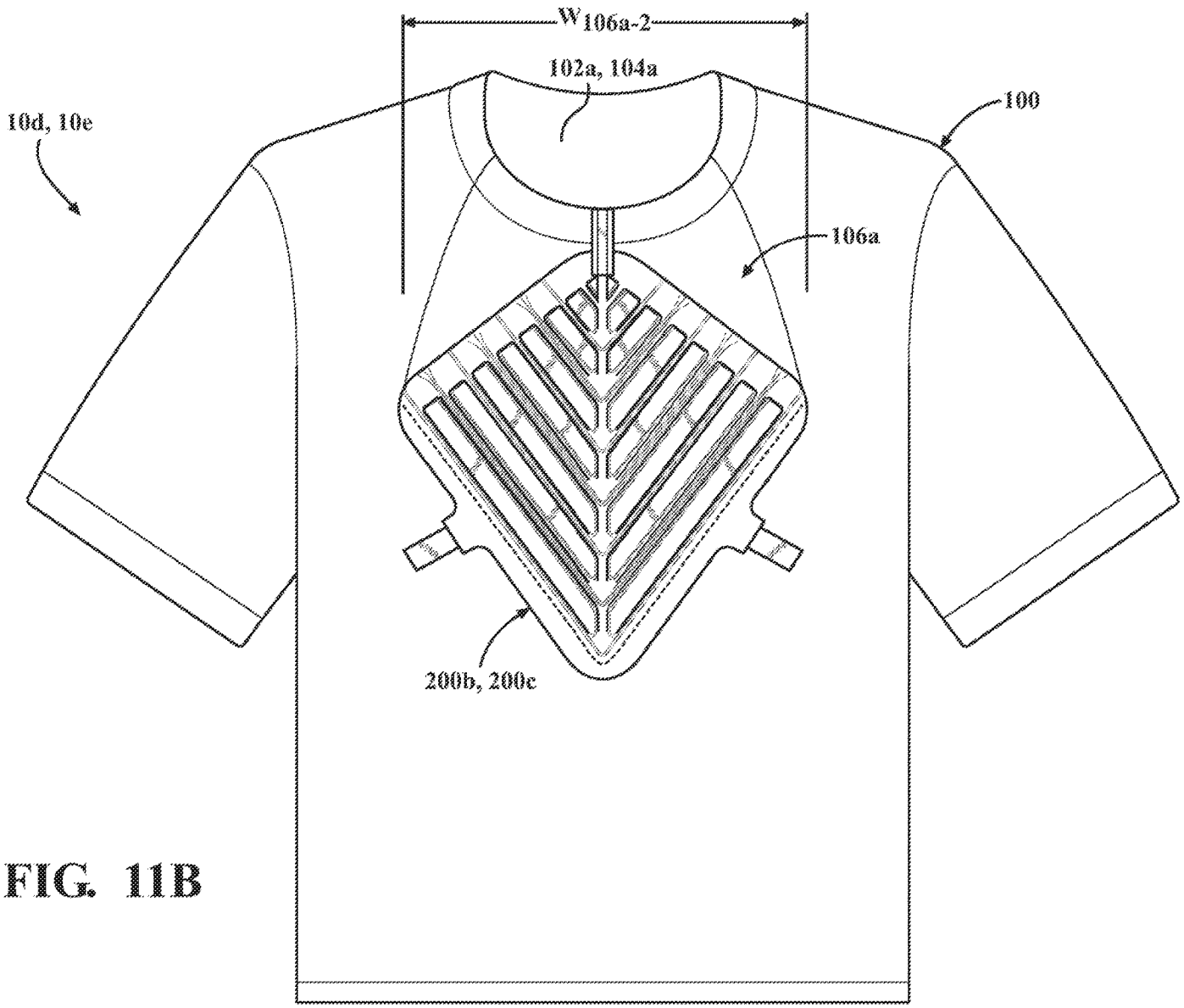
FIG. 11B is an elevation view of the garment of FIG. 11A, where the adjustment element is in an expanded configuration.

As shown in FIGS. 11A and 11B in another example of an article 10*d*, 10*e*, the adjustment element 200*b*, 200*c* is incorporated on a garment, such as a shirt 100*a*. Here, the shirt 100*a* includes an interior void 102*a* forming a body cavity, where an opening 104*a* in the shirt 100*a* provides access to the interior void 102*a*. As shown, the shirt 100*a* may include an adjustment region 106*a*. As with the article of footwear 100, the adjustment region 106*a* of the shirt 100*a* may be formed of an elastic material, or may include a gap in the material of the shirt 100*a*.

When the adjustment element 200*b*, 200*c* is incorporated in a shirt 100*a* or other garment, the adjustment element 200*b*, 200*c* will be disposed over the adjustment region 106*a*. In some examples, the adjustment region 106*a* may be formed adjacent to the opening 104*a* to adjust a fit of the opening 104*a* around the body. For example, where the opening 104*a* is provided as a neck opening 104*a*, as shown, the adjustment element 200*b*, 200*c* may be configured to adjust a fit of the neck opening 104*a* around the neck of a wearer. In other examples, the adjustment region 106*a* and the adjustment element 200*b*, 200*c* are spaced apart from the opening 104*a* to adjust a fit of an intermediate portion of the shirt 100*a*.

Figure 12A:
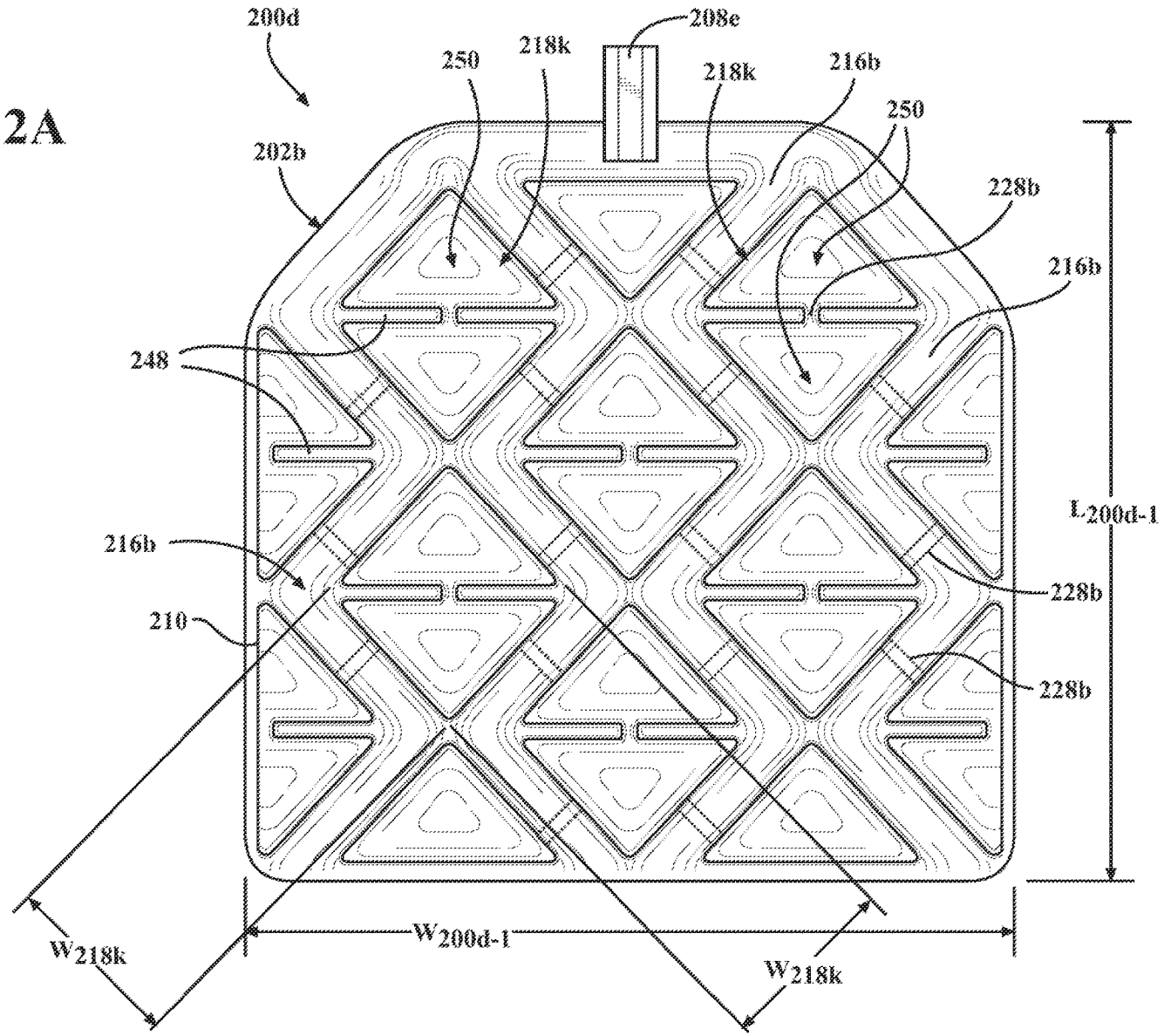
FIG. 12A is a top plan view of an adjustment element according the principals of the present disclosure, where the adjustment element is in a contracted configuration.
Figure 12B:
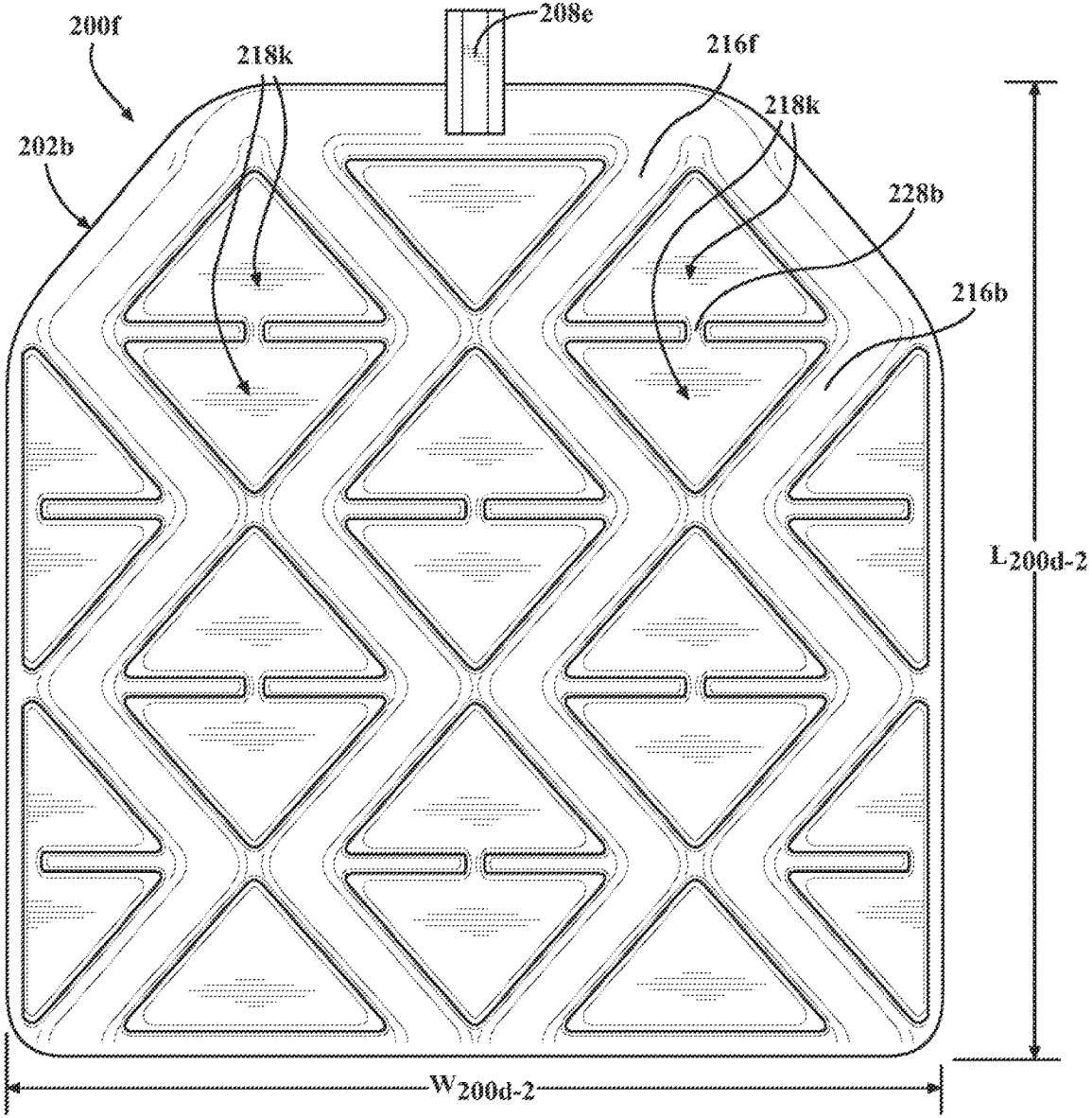
FIG. 12B is a top plan view of the adjustment element of FIG. 12A, where the adjustment element is in an expanded configuration.

Turning now to FIGS. 12A and 12B, another example of an adjustment element 200*d* is shown. Here, the adjustment element 200*d* is formed with a similar construction as the adjustment elements 200-200*c*, and includes a bladder 202*b* having a pair of barrier layers 210 joined to each other along a seam 216*b* to form a plurality of chambers 218*k*. Generally, the adjustment element 200*d* has an auxetic structure, where a length $L_{200d}$ and a width $W_{200d}$ of the adjustment element 200*d* are minimized when the adjustment element 200*d* is moved to the contracted configuration (FIG. 12A), and are maximized when the adjustment element 200*d* is moved to the expanded configuration (FIG. 12B).

With reference to FIGS. 12A and 12B, the seam 216*b* of the bladder 202*b* forms an interconnected network or mesh defining a plurality of discrete polygonal chambers 218*k*. In the illustrated example, the seam 216*b* defines a plurality of diamond or square-shaped chambers 218*k* arranged in rows and columns to provide the bladder 202*b* with the auxetic structure. The seam 216*b* may include a plurality of fingers 248 that partially divide each of the chambers 218*k* into an opposing pair of triangular-shaped chamber sections 250. Each of the chambers 218*k* may be fluidly coupled to each other with one or more conduits 228*b* formed in the seam 216*b*.

The adjustment element 200*d* may further include one or more valves, as discussed above. In the illustrated example, a single two-way valve 208*e* is fluidly connected to each of the chambers 218*k* through the network of conduits 228*b*. Accordingly, the valve 208*e* may function as both an exhaust valve for removing fluid from the bladder 202*b*, and as an intake valve for providing fluid to the bladder 202*b*.

The adjustment element 200*b* includes a compressible component disposed within each of the chambers 218*k* and configured to bias the barrier layers 210 of the adjustment element 200*b* apart from each other. As with the examples provided above, the compressible component may include a plurality of unitary compressible elements each filling one of the chambers 218*k* and formed of a resilient material 218*k*, such as open-cell foam. Additionally or alternatively, the compressible component of the adjustment element 200*b* may include a plurality of the compressible particles 244 disposed within each chamber 218*k*.

In use, the adjustment element 200*d* is moved between the contracted configuration (FIG. 12A) and the expanded configuration (FIG. 12B) by changing a fluid pressure within the bladder 202*b*. In FIG. 12A, the adjustment element 200*d* is arranged in the contracted configuration when a fluid pressure within the bladder 202*b* is equal to or greater than atmospheric pressure, such that the compressible component within each chamber 218*k* can bias the barrier layers 210 apart from each other. Here, as the barrier layers 210 are biased apart from each other, a length $L_{218k}$ and a width $W_{218k}$ of each chamber 218*k* is minimized and the chambers 218*k* and seams 216*b* are drawn towards each other. Accordingly, an overall length $L_{200d\text{-}1}$ and overall width $W_{200d\text{-}1}$ of the adjustment element 200*b* is minimized.

To move the adjustment element 200*d* to the expanded configuration, a volume of fluid is exhausted from within the bladder 202*b* through the valve 208*e*. As with previous examples, the fluid may be exhausted by generating a pressure differential across the valve 208*e*, such that the fluid pressure within the bladder 202*b* is greater than the fluid pressure on an exterior of the valve 208*e*. As the fluid is exhausted from the bladder 202*b*, the barrier layers 210 are drawn towards each other to compress the compressible component within the interior void of the bladder 202*b*, reducing a thickness of each of the chambers 218*k*. Reduction in the thicknesses of the chambers 218*k* results in an increase in the width $W_{218k}$ and the length $L_{218k}$ of each chamber 218*k*, which consequently results in the overall length $L_{200d\text{-}2}$ and overall width $W_{200d\text{-}2}$ of the bladder 202*b* being maximized.

With the adjustment element 200*d* in the expanded configuration, the valve 208*e* is then closed to prevent fluid flow into the bladder. As discussed above, the compressible component applies a biasing force to the barrier layers 210 to move the barrier layers 210 apart from each other. However, with the valve 208*e* in the close position, fluid is unable to flow into the bladder 202*b* and a vacuum is formed within the interior void, thereby maintaining the adjustment element 200*d* in the expanded configuration until the valve 208*e* is opened to allow fluid to return to the interior void.

Figure 13A:
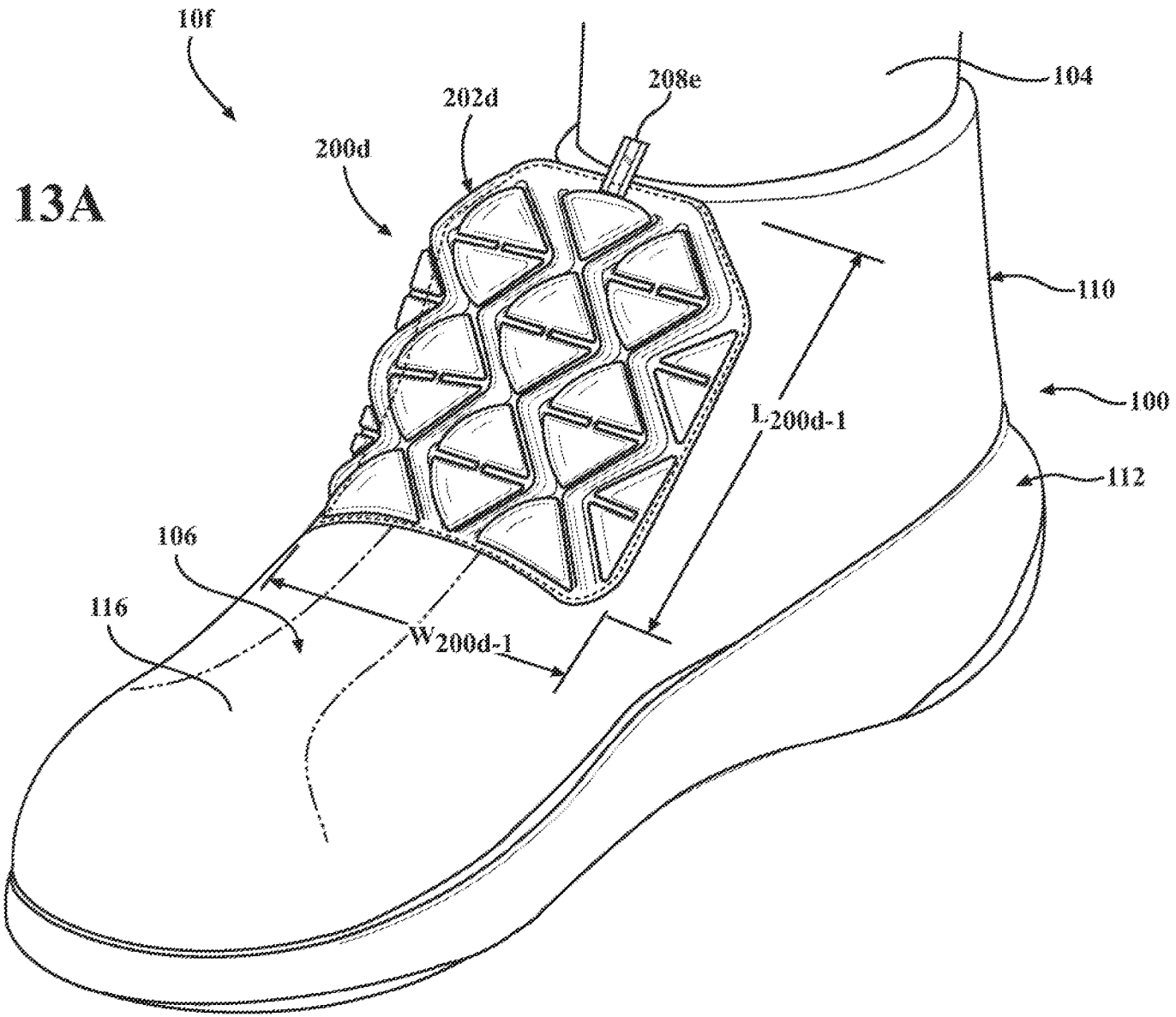
FIG. 13A is a perspective view of an article of footwear incorporating the adjustment element of FIG. 12A, where the adjustment element is in the contracted configuration.
Figure 13B:
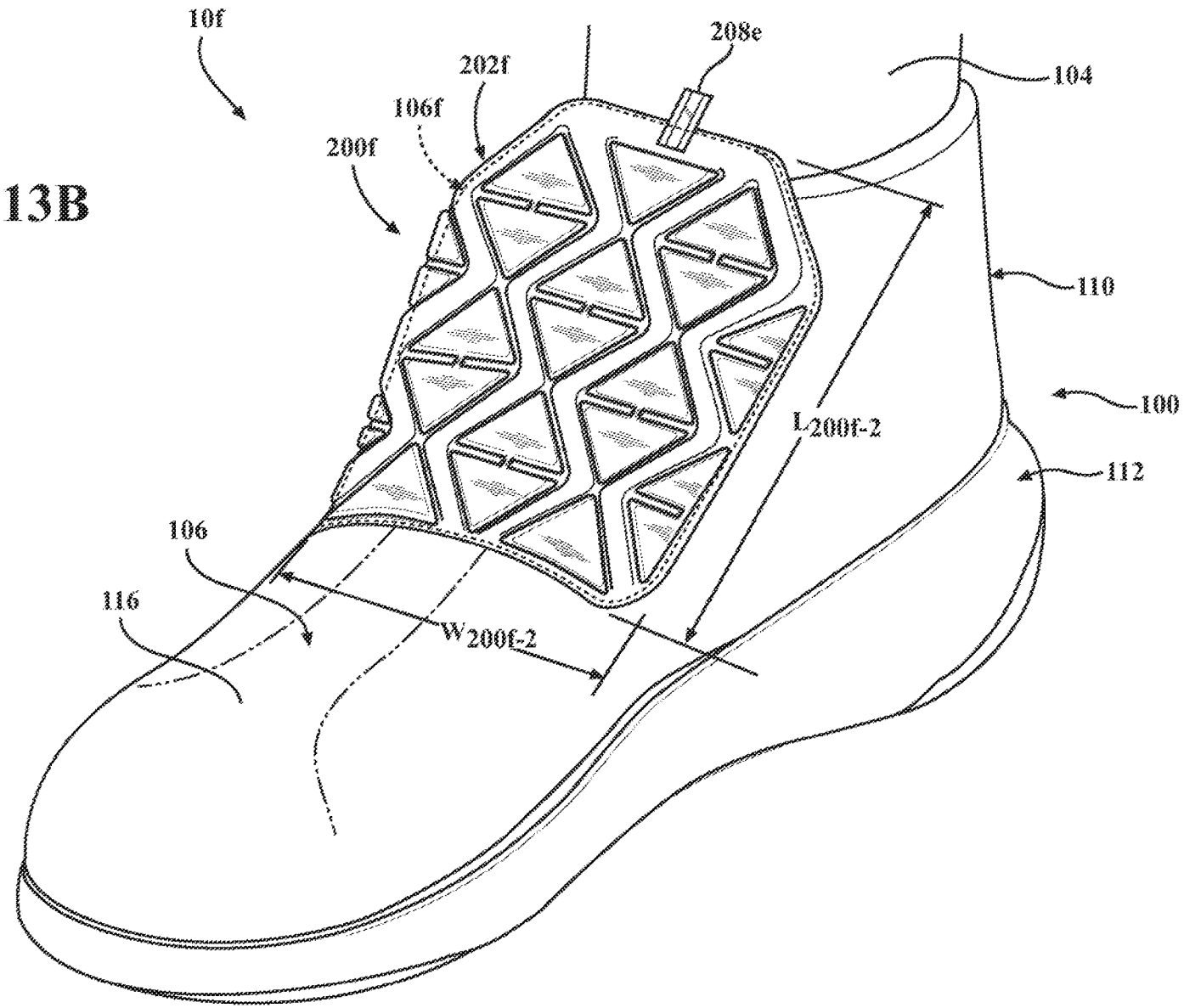
FIG. 13B is a perspective view of the article of footwear of FIG. 13A, where the adjustment element is in the expanded configuration.
Figure 14A:
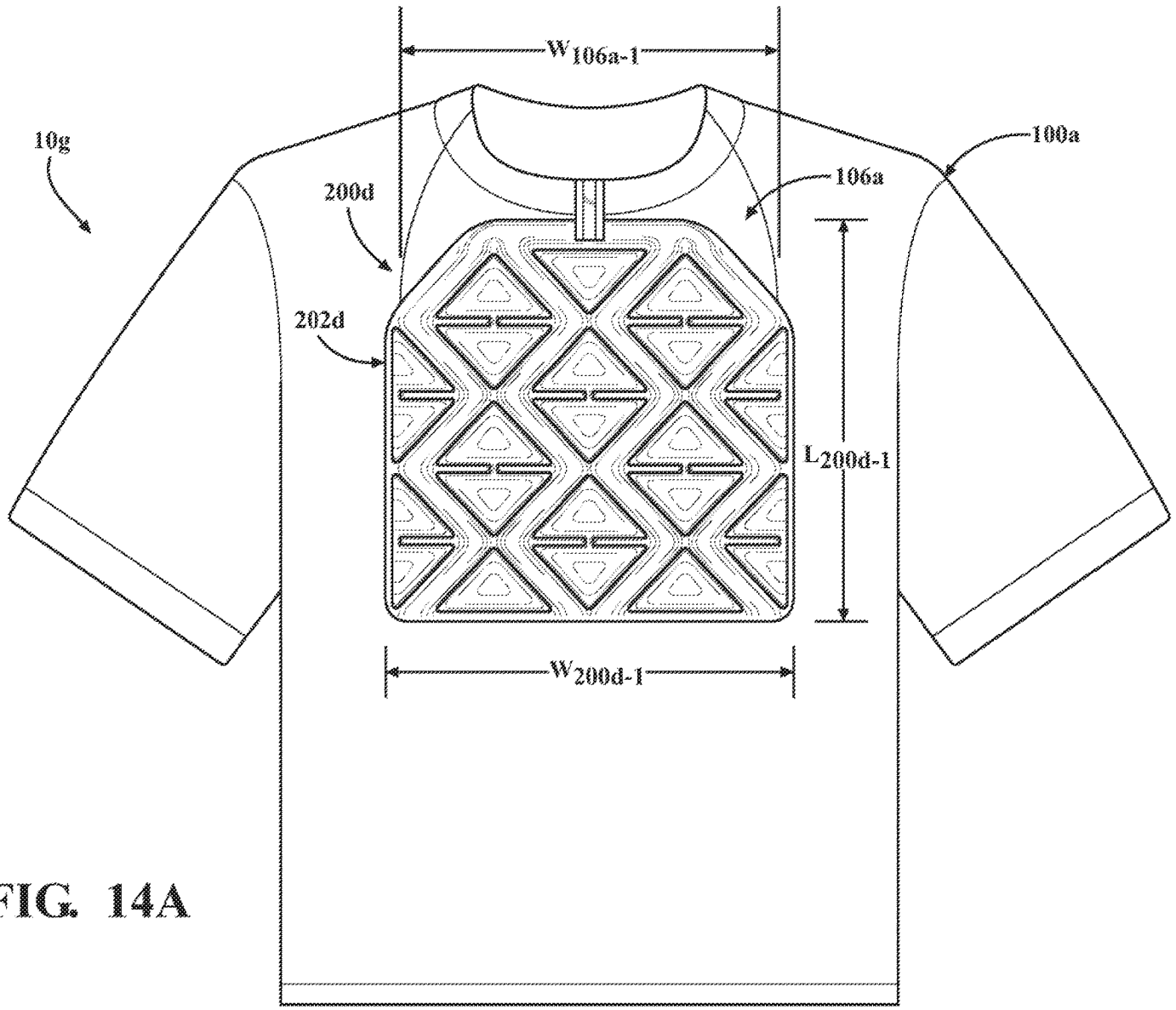
FIG. 14A is an elevation view of a garment incorporating the adjustment element of FIG. 12A, where the adjustment element is in the contracted configuration.
Figure 14B:
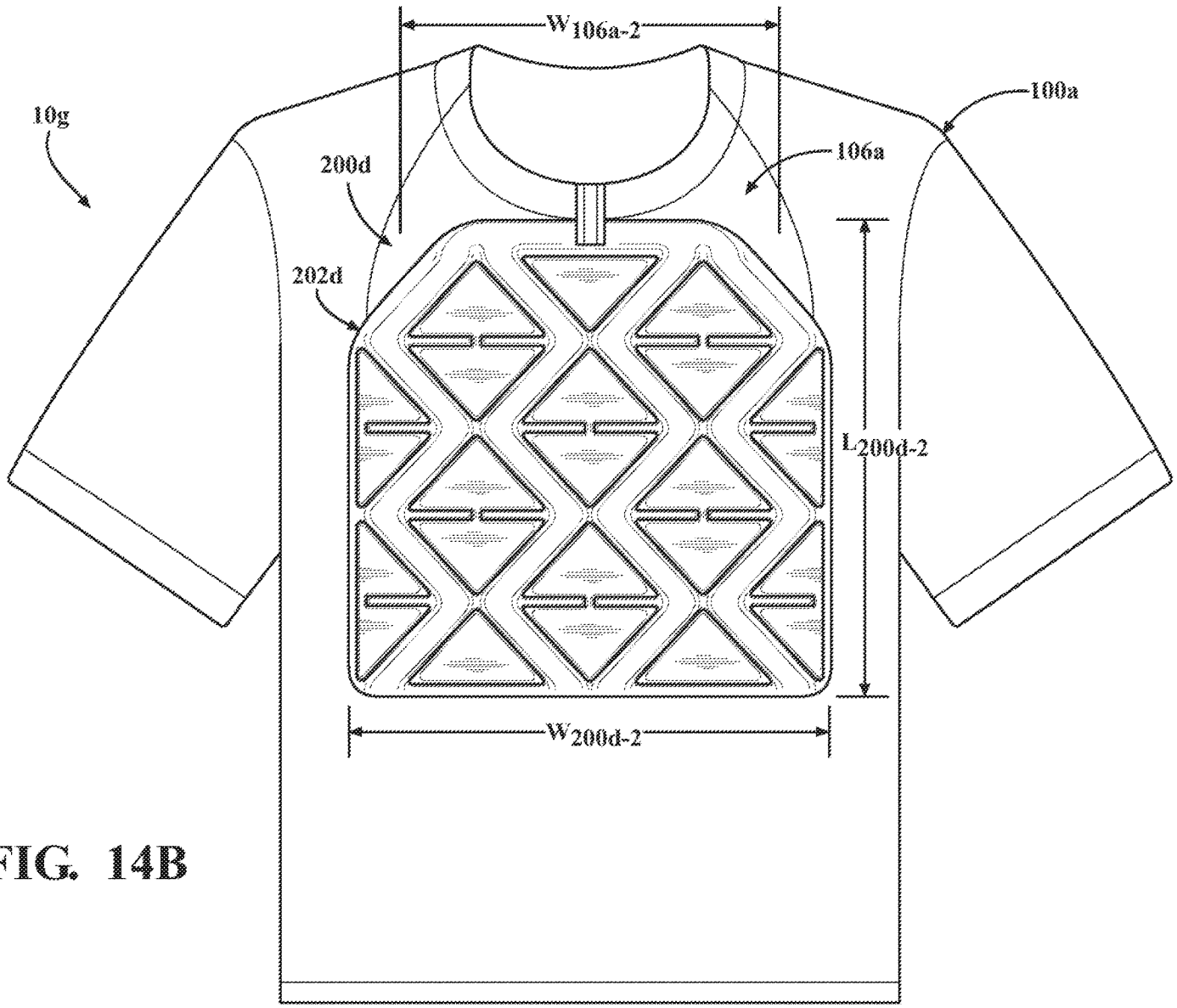
FIG. 14B is a perspective view of the article of apparel of FIG. 14A, where the adjustment element is in an expanded configuration.

With reference to FIGS. 13A and 13B, the adjustment element 200*d* is incorporated onto the article of footwear 100 described above. FIGS. 14A and 14B show the adjustment element 200*d* incorporated onto a garment, such as a shirt 100*a*. In both examples, the auxetic structure of the adjustment element 200*b* allows a height and width of the adjustable region 106, 106*a* to be expanded and contracted as the adjustment element 200*d* is moved between the expanded state and the contracted state. Thus, unlike the previous examples, which provide two-way fit adjustment, the auxetic structure provides for four-way fit adjustment.

The following Clauses provide an exemplary configuration for an article of footwear described above.

Clause 1: An article comprising, a receptacle defining an interior void; and an adjustment element attached to the receptacle and including a bladder defining one or more chambers each having a compressible component disposed therein, the adjustment element operable between a contracted configuration providing the receptacle with a first size and an expanded configuration providing the receptacle with a second size different than the first size by adjusting a pressure within the one or more chambers.

Clause 2: The article of Clause 1, wherein the receptacle includes an opening providing access to the interior void, the adjustment element being disposed adjacent to the opening and operable to move the opening between the first size and the second size.

Clause 3: The article of Clauses 1 or 2, wherein the bladder includes a first barrier layer and a second barrier layer joined together at discrete locations to define the one or more chambers.

Clause 4: The article of Clause 3, wherein the bladder includes a first bearing layer adjacent to the first barrier layer and a second bearing layer adjacent to the second barrier layer.

Clause 5: The article of Clause 4, wherein the compressible component is disposed between the first bearing layer and the second bearing layer.

Clause 6: The article of any one of Clauses 4 or 5, wherein the first bearing layer and the second bearing layer have a lower coefficient of friction than the first barrier layer and the second barrier layer.

Clause 7: The article of any one of Clauses 4-6, wherein the bearing layer is formed of a fabric material.

Clause 8: The article of any one of the preceding clauses, wherein the compressible component includes a unitary element.

Clause 9: The article of any one of Clauses 1-7, wherein the compressible component includes a plurality of compressible particles.

Clause 10: The article of Clause 9, wherein the plurality of compressible particles are spherical beads.

Clause 11: The article of any one of the preceding clauses, wherein the compressible component is formed of a foam material.

Clause 12: The article of any one of the preceding clauses, wherein the adjustment element includes a valve providing fluid communication between each of the one or more chambers and an exterior of the bladder.

Clause 13: The article of any one of the preceding clauses, wherein the one or more chambers includes a plurality of the chambers.

Clause 14: The article of Clause 13, wherein the plurality of the chambers are in fluid communication with each other.

Clause 15: The article of Clause 1, wherein the receptacle is an upper of an article of footwear.

Clause 16: The article of Clause 15, wherein the adjustment element is disposed on an instep region of the upper.

Clause 17: The article of Clauses 15 or 16, wherein the adjustment element includes a first wing chamber attached to the upper on a lateral side, a second wing chamber attached to the upper on a medial side, and a central chamber disposed between and connecting the first wing chamber and the second wing chamber.

Clause 18: The article of Clause 17, wherein in the contracted configuration the first wing chamber and the second wing chamber are folded between the central chamber and the upper, and in the expanded configuration the first wing chamber and the second wing chamber are spaced outwardly from the central chamber.

Clause 19: The article of Clause 1, wherein the receptacle is a shirt.

Clause 20: An adjustment element for an article, the adjustment element comprising a bladder forming an interior void having a plurality of chambers, a compressible component having a portion disposed within each one of the chambers, and a first valve attached to the bladder and providing fluid communication between the interior void and an exterior of the bladder.

Clause 21: The adjustment element of Clause 20, wherein the bladder includes a first barrier layer and a second barrier layer joined to the first barrier layer along a web area to define each of the plurality of the chambers.

Clause 22: The adjustment element of Clause 21, wherein the web area defines a central chamber, a first wing chamber on a first side of the central chamber, and a second wing chamber on a second side of the central chamber.

Clause 23: The adjustment element of Clause 21, wherein the web area defines a first series of elongate chambers and a second series of elongate chambers that diverge from the first series of the elongate chambers.

Clause 24: The adjustment element of Clause 21, wherein the web area defines an auxetic structure.

Clause 25: The adjustment element of Clause 21, wherein the bladder includes a first bearing layer covering the first barrier layer within each of the plurality of the chambers and a second bearing layer covering the second barrier layer within each of the plurality of the chambers.

Clause 26: The adjustment element of any one of the preceding clauses, wherein the compressible component includes a plurality of unitary compressible elements each disposed within one of the chambers.

Clause 27: The adjustment element of any one of Clauses 20-25, wherein the compressible component is a plurality of compressible particles.

Clause 28: The adjustment element of Clause 20, wherein the first valve is a bi-directional valve.

Clause 29: The adjustment element of any of the preceding clauses, wherein the bladder includes the first valve and a second valve, the first valve being a one-way intake valve and the second valve being a one-way exhaust valve.

Clause 30: The adjustment element of Clause 20, further comprising a pump in communication with the interior void through the first valve.

Clause 31: An article of footwear incorporating the adjustment element of any one of the preceding clauses.

Clause 32: An article of clothing incorporating the adjustment element of any one of the preceding clauses.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

The invention claimed is:

1. An article comprising:

a receptacle defining an interior void; and an adjustment element attached to the receptacle and including a bladder defining one or more chambers each having a compressible component disposed therein, the adjustment element operable between a contracted configuration providing the receptacle with a first size and an expanded configuration providing the receptacle with a second size different than the first size by adjusting a pressure within the one or more chambers, the one or more chambers including a central chamber and a first wing chamber, the first wing chamber folded beneath the central chamber and disposed between the central chamber and the receptacle when in the contracted configuration.

2. The article of claim 1, wherein the receptacle includes an opening providing access to the interior void, the adjustment element being disposed adjacent to the opening and operable to move the opening between the first size and the second size.

3. The article of claim 1, wherein the bladder includes a first barrier layer and a second barrier layer joined together at discrete locations to define the one or more chambers.

4. The article of claim 3, wherein the bladder includes a first bearing layer adjacent to the first barrier layer and a second bearing layer adjacent to the second barrier layer.

5. The article of claim 4, wherein the compressible component is disposed between the first bearing layer and the second bearing layer.

6. The article of claim 4, wherein the first bearing layer and the second bearing layer have a lower coefficient of friction than the first barrier layer and the second barrier layer.

7. The article of claim 1, wherein the compressible component includes a unitary element.

8. The article of claim 1, wherein the compressible component is formed of a foam material.

9. The article of claim 1, wherein the adjustment element includes a valve providing fluid communication between each of the one or more chambers and an exterior of the bladder.

10. The article of claim 1, wherein the one or more chambers further includes a second wing chamber formed on an opposite side of the central chamber than the first wing chamber.

* * * * *